US011674697B2

(12) United States Patent
Choi et al.

(10) Patent No.: US 11,674,697 B2
(45) Date of Patent: Jun. 13, 2023

(54) INDOOR UNIT FOR AIR CONDITIONER

(71) Applicant: LG ELECTRONICS INC., Seoul (KR)

(72) Inventors: Sung Gyu Choi, Seoul (KR); Kangyoung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 155 days.

(21) Appl. No.: 16/807,667

(22) Filed: Mar. 3, 2020

(65) Prior Publication Data

US 2020/0284441 A1 Sep. 10, 2020

(30) Foreign Application Priority Data

Mar. 4, 2019 (KR) ..... 10-2019-0024946

(51) Int. Cl.

| | |
|---|---|
| ***F24F 1/0087*** | (2019.01) |
| ***F24F 1/0014*** | (2019.01) |
| ***F24F 13/08*** | (2006.01) |
| ***F24F 1/005*** | (2019.01) |
| ***F24F 1/0018*** | (2019.01) |
| ***F24F 13/06*** | (2006.01) |
| ***F24F 13/20*** | (2006.01) |

(52) U.S. Cl.

CPC ..... *F24F 1/0087* (2019.02); *F24F 1/0018* (2013.01); *F24F 13/06* (2013.01); *F24F 13/082* (2013.01); *F24F 13/20* (2013.01)

(58) Field of Classification Search

CPC ..... F24F 1/0087; F24F 1/0018; F24F 1/005; F24F 1/0014; F24F 13/082

See application file for complete search history.

(56) References Cited

U.S. PATENT DOCUMENTS

| | | | | |
|---|---|---|---|---|
| 5,664,730 | A * | 9/1997 | Vallieres | F24D 19/0082 237/78 A |
| 2013/0249124 | A1* | 9/2013 | Staniforth | F04D 25/08 261/128 |
| 2016/0169541 | A1* | 6/2016 | Lu | A61L 9/12 422/114 |
| 2017/0122595 | A1 | 5/2017 | Lee et al. | |
| 2017/0191692 | A1* | 7/2017 | Hwang | F24F 13/28 |
| 2018/0080665 | A1* | 3/2018 | Jung | F24F 1/0011 |

FOREIGN PATENT DOCUMENTS

| | | | |
|---|---|---|---|
| CN | 101101139 | A | 1/2008 |
| CN | 202350196 | U | 7/2012 |
| CN | 106642372 | A | 5/2017 |
| CN | 107289523 | A | 10/2017 |
| CN | 207486962 | U | 6/2018 |
| EP | 3163180 | A1 | 5/2017 |
| JP | S59-175829 | A | 10/1984 |
| JP | 20180021682 | A | 2/2018 |
| KR | 200154186 | Y1 * | 8/1999 |
| KR | 10-2013-0109738 | A | 10/2013 |

* cited by examiner

*Primary Examiner* — Steven S Anderson, II
(74) *Attorney, Agent, or Firm* — Dentons US LLP

(57) ABSTRACT

An indoor unit for an air conditioner, in which a diffuser outlet through which humidified air is discharged is placed between a front panel and a grill that guides the discharged air, may produce the effect that discharged air pushes discharged humidified air, thereby allowing the humidified air to flow far away from a lateral outlet. As a result, formation of droplets on a surface of the front panel made of a metallic material may be minimized.

15 Claims, 22 Drawing Sheets

INDOOR UNIT FOR AIR CONDITIONER

CROSS-REFERENCE TO RELATED APPLICATION

This application claims priority to and the benefit of Korean Patent Application No. 10-2019-0024946, filed in Korea on Mar. 4, 2019, the disclosure of which is incorporated herein by reference in its entirety.

BACKGROUND

1. Field

The present disclosure relates to an indoor unit for an air conditioner, and, more particularly, to an indoor unit for an air conditioner that can supply humidified air to an indoor space.

2. Background

An indoor unit for a split-type air conditioner is placed in the indoor space while an outdoor unit is placed in an outdoor space. The split-type air conditioner can cool, heat, or dehumidify the air within an indoor space using refrigerants circulating between the indoor unit and outdoor unit.

Indoor units for the split-type air conditioners are classified as a floor-mounted indoor unit that stands up on the floor of an indoor space, a wall-mounted air conditioner that is hung on the wall of an indoor space, a ceiling-mounted air conditioner that is installed on the ceiling of an indoor space and the like, according to the way in which the indoor units are installed.

The standing indoor unit of the related art may perform dehumidification of indoor air while cooling the indoor air, but may not perform humidification of indoor air while heating the indoor air.

A standing indoor unit provided with a humidifier is disclosed in Korean Patent Publication No. 10-2013-0109738.

As for the standing indoor unit in KR 10-2013-0109738, the humidifier is provided inside a main body forming an appearance of the indoor unit. The humidifier therein has a structure in which water collected in a drain pan is stored in a water tank, in which an absorption member is wetted by the stored water, and in which the absorption member naturally evaporates the absorbed water.

The humidifier in KR 10-2013-0109738 uses condensate flowing down from a heat exchanger, it does not use clean or fresh water. Therefore, large amounts of foreign substances, separated from a surface of the heat exchanger, may be found in the water stored in the water tank. And fungi or bacterial are highly likely to breed in the foreign substances.

As for the humidifier in KR 10-2013-0109738, water is evaporated in the main body. Accordingly, the evaporated water may be attached to parts and components in the main body or to an internal wall of the main body, and may cause breeding of fungi or bacteria in the main body.

As for the humidifier in KR 10-2013-0109738, although water is evaporated in the main body and a blowing fan is operated, all the moisture evaporated by the blowing fan is not discharged to the indoor space, and, when the temperature of the heat exchanger is low, is re-attached to the surface of the heat exchanger.

When the temperature of indoor space is low, humidity of indoor air is low. Accordingly, heating is usually performed in an indoor space requiring humidification. Because the humidifier in KR 10-2013-0109738 performs humidification using condensate of the heat exchanger, the humidifier may provide humidification only during a cooling process, and, because condensate is not produced during a heating process, may not provide humidification.

SUMMARY

The present disclosure solves the above-mentioned problems. The present disclosure is directed to an indoor unit for an air conditioner that may minimize formation of droplets on lateral surfaces of a front panel made of a metallic material.

The present disclosure is directed to an indoor unit for an air conditioner that may minimize formation of droplets at a lateral outlet of a cabinet assembly, which may be caused due to humidified air discharged from a diffuser.

The present disclosure is directed to an indoor unit for an air conditioner that may effectively diffuse humidified air, discharged from a lateral outlet by discharged air.

The present disclosure is directed to an indoor unit for an air conditioner that may minimize formation of droplets by installing a diffuser that discharges humidified air and a side grill that discharges discharged air.

The present disclosure is directed to an indoor unit for an air conditioner that may minimize formation of droplets through relative placement of a front panel, a diffuser, and a side grill.

The present disclosure is directed to a relationship between a diffusion angle of a diffuser outlet through which humidified air may be effectively discharged, and a vane.

The present disclosure is directed to a placement of a diffuser and a vane to minimize air resistance against air flows of a fan.

The present disclosure is directed to directions of a shroud and a hub, and a placement of a vane or a diffuser to allow humidified air to easily flow.

Objectives of the present disclosure are not limited to what has been described. Additionally, other objectives that have not been mentioned may be clearly understood from the following description by one having ordinary skill in the art to which the present disclosure pertains.

According to the present disclosure, a diffuser outlet through which humidified air may be discharged may be placed between a front panel and a grill that guides discharged air, thereby producing the effect that discharged air pushes discharged humidified air. By doing so, the humidified air is allowed to flow far away from a lateral outlet. As a result, because the humidified air flows far away from the diffuser outlet, formation of droplets on a surface of the front panel made of a metallic material may be minimized.

According to the present disclosure, humidified air may be carried and may flow onto discharged air having a high speed and a high pressure because the humidified air may be discharged to a front of a vane, thereby effectively diffusing the humidified air to indoor space.

According to the present disclosure, a diffuser that discharges humidified air may be placed at a front of a side grill that discharges discharged air, thereby producing the effect that discharged air pushes discharged humidified air. By doing so, the humidified air may be allowed to flow far away from the lateral outlet. Additionally, because the humidified air flows far away from the diffuser outlet, formation of droplets on a surface of the front panel made of a metallic material may be minimized.

According to the present disclosure, the diffuser outlet may be placed at a rear of the front panel, may be placed further inwards than lateral surfaces of the front panel, and may be placed at a front of the side grill, thereby improving linearity of humidified air discharged from the diffuser outlet. Additionally, the linearity of humidified air may be improved, thereby minimizing formation of droplets on a surface of the front panel made of a metallic material.

According to the present disclosure, a diffusion angle of the diffuser outlet through which humidified air may be effectively discharged, and an inclination angle of the vane are crossed, thereby effectively mixing humidified air with discharged air having a large amount of air movement.

According to the present disclosure, the diffusion angle of the diffuser outlet through which humidified air may be effectively discharged may be formed in a leftward direction or a rightward direction, and the inclination angle of the vane may be diagonally formed forwards, thereby carrying humidified air onto discharged air having a large amount of wind to allow the humidified air to flow far away. Additionally, humidified air may be mixed with discharged air, thereby effectively lowering a high temperature of the humidified air.

According to the present disclosure, the diffuser outlet may be placed between a direction of an outer end of a shroud of a fan and a direction of an outer end of a hub of the fan, thereby allowing humidified air to be pushed by discharged air and to easily flow forwards in a diagonal direction.

According to the present disclosure, the vane may be placed between the direction of the outer end of the shroud of the fan and the direction of the outer end of the hub of the fan, thereby effectively guiding discharged air.

According to the present disclosure, the diffuser outlet may be placed between the direction of the outer end of the shroud of the fan and the direction of the outer end of the hub of the fan, and the diffuser outlet may be placed closer to the direction of the outer end of the hub of the fan than to the direction of the outer end of the shroud of the fan, thereby effectively mixing humidified air with discharged air and allowing the humidified air to be carried onto the discharged air and to flow far away.

An exemplary indoor unit for an air conditioner may include a cabinet that forms an internal space and that includes an inlet through which indoor air may be introduced into the internal space and an outlet through which air in the internal space may be discharged to indoor space, a fan assembly that may be placed in the internal space and that discharges air, suctioned through the inlet, to the outlet, a grill that may be placed at the outlet and that guides discharged air discharged by the fan assembly, a front panel that may be placed at a front of the cabinet assembly, a humidified air generator that may be placed at the cabinet assembly and that evaporates water stored therein and generates humidified air, and a diffuser that connects to the humidified air generator, that receives the humidified air and that discharges the humidified air supplied by the humidified air generator, where the diffuser includes a diffuser outlet through which the humidified air may be discharged, and the diffuser outlet may be placed between the front panel and the grill with respect to a front-rear direction which may be perpendicular to a front surface of the front panel.

The front panel and the diffuser outlet of the exemplary indoor unit for an air conditioner may be spaced apart in the front-rear direction.

An outer end of the diffuser outlet of the exemplary indoor unit for an air conditioner may be placed within a left-right width of the front panel.

The front panel of the exemplary indoor unit for an air conditioner may be made of a metallic material, and the diffuser outlet may be placed further rearwards than a rear end of a left surface or a rear end of a right surface of the front panel.

The grill of the exemplary indoor unit for an air conditioner may include a vane that guides a discharge direction of air, and the diffuser and the vane may be placed such that a discharge direction of humidified air discharged from the diffuser outlet and an inclination direction of the vane are crossed.

The diffuser of the exemplary indoor unit for an air conditioner may include a front diffuser housing that forms a front surface of the diffuser and a rear diffuser housing that forms a rear surface of the diffuser, where the diffuser outlet may be formed between an outer end of the front diffuser housing and an outer end of the rear diffuser housing.

A plurality of vanes of the exemplary indoor unit for an air conditioner may be placed in the front-rear direction, and, from a flat cross section perspective, the front surface of the front panel and an inclination direction of the vane form a first contained angle, the front diffuser housing and the front surface of the front panel form a second contained angle, the rear diffuser housing and the front surface of the front panel form a third contained angle, and the third contained angle may be greater than the second contained angle and may be smaller than the first contained angle.

The fan assembly of the exemplary indoor unit for an air conditioner includes a hub to which a rotating shaft may be coupled at a center thereof, a shroud that may be spaced apart from a rear of the hub and that includes an inlet into which air may be suctioned at a central portion thereof, and a fan that includes a plurality of blades placed between the hub and the shroud, and, from a flat cross section perspective, a direction, faced by an outer circumferential end of the shroud, and the front surface of the front panel may form a fourth contained angle smaller than the first contained angle.

The diffuser outlet and the plurality of vanes of the exemplary indoor unit for an air conditioner may be placed between a direction faced by an outer circumferential end of the hub and the direction faced by the outer circumferential end of the shroud.

An outer end of a front most vane among the plurality of vanes may be placed between the outer end of the front diffuser housing and the outer end of the rear diffuser housing with respect to a left-right direction that is a widthwise direction of the front panel of the exemplary indoor unit for an air conditioner.

The front panel of the exemplary indoor unit for an air conditioner may include a front panel body that forms a front surface of the front panel, and a front panel side that extends rearwards from an edge of the front panel body in a lateral direction of the front panel body and that forms a lateral surface of the front panel, and the diffuser may further include a protrusion that protrudes forwards from the outer end of the front diffuser housing.

A front-rear distance between an end at a front of the protrusion and a rear end of the front side panel of the exemplary indoor unit for an air conditioner may be at least 2 mm.

A total of the front-rear distance between the end at the front of the protrusion and the rear end of the front panel side of the exemplary indoor unit for an air conditioner, and a front-rear length of the protrusion may be 5 mm or more and 10 mm or less.

The protrusion of the diffuser outlet of the exemplary indoor unit for an air conditioner may be placed further inwards than an outer surface of the front panel side.

The front panel of the exemplary indoor unit for an air conditioner may include a front panel body that forms a front surface of the front panel, and a front panel side that extends rearwards from an edge of the front panel body in a lateral direction of the front panel body and that forms a lateral surface of the front panel body, where an outer end of the diffuser outlet may be placed further rearwards than the rear end of the front panel side, and the outer end of the diffuser outlet may be placed further inwards than the outer surface of the front panel side.

The indoor unit for an air conditioner has one or more of the following advantages.

First, the diffuser that discharges humidified air may be placed further rearwards than a lateral surface of the front panel, thereby minimizing formation of droplets at the front panel made of a metallic material.

Second, humidified air discharged from the diffuser may be placed at a front of the vane, and may be carried and flow onto discharged air having a high wind speed and a high wind pressure, thereby effectively being diffused to indoor space.

Third, the diffuser that discharges humidified air may be placed at a front of a side grill that discharges discharged air, thereby producing the effect that discharged air pushes discharged humidified air. By doing so, the humidified air may flow far away from a lateral outlet.

Fourth, humidified air flows away from the diffuser outlet, thereby minimizing formation of droplets on a surface of the front panel made of a metallic material.

Fifth, the diffuser outlet may be placed at a rear of the front panel, may be placed further inwards than a lateral surface of the front panel, and may be placed at the front of the side grill, thereby improving linearity of humidified air discharged from the diffuser outlet.

Sixth, linearity of humidified air is improved, thereby minimizing formation of droplets on a surface of the front panel made of a metallic material.

Seventh, a diffusion angle of the diffuser outlet through which humidified air may be effectively discharged, and an inclination angle of the vane may be crossed, thereby effectively mixing humidified air with discharged air having a large amount of wind.

Eight, the diffusion angle of the diffuser outlet through which humidified air is effectively discharged may be formed in a leftward direction or a rightward direction, and the inclination angle of the vane may be diagonally formed forwards, thereby carrying humidified air onto discharged air having a large amount of wind to allow the humidified air to flow far away.

Ninth, humidified air is mixed with discharged air, thereby effectively lowering a high temperature of the humidified air.

Tenth, the diffuser outlet may be placed between a direction of an outer end of the shroud of the fan and a direction of an outer end of the hub of the fan, thereby allowing humidified air to be pushed by discharged air and to readily flow forwards in a diagonal direction.

Eleventh, the vane may be placed between the direction of the outer end of the shroud of the fan and the direction of the outer end of the hub of the fan, thereby allowing the vane to guide discharged air effectively.

Twelfth, the diffuser outlet may be placed near the direction of the outer end of the hub of the fan, thereby effectively mixing humidified air and discharged air and allowing humidified air to be carried onto discharged air and to flow far away.

Thirteenth, a door assembly and the diffuser outlet are spaced apart in the front-rear direction, thereby minimizing the possibility that moisture of humidified air is attached to a lateral surface of the door assembly through the distance.

Fourteenth, an outer end of the diffuser outlet may be placed further rearwards than the door assembly and may be placed further inwards than a lateral surface of the door assembly, thereby minimizing the possibility that moisture of humidified air is attached to the lateral surface of the door assembly.

Fifteenth, the side grill further includes the vane that guides a discharge direction of air, and a discharge direction of humidified air discharged from the diffuser outlet and an inclination direction of the vane are crossed, thereby effectively mixing humidified air and discharged air and allowing humidified air to be carried onto discharged air having a high wind pressure and a large amount of wind and to flow far away from the door assembly.

Sixteenth, a front surface of the door assembly and the inclination direction of the vane form a contained angle A1, and the contained angle A1 may be set to 40 degrees to 50 degrees, thereby allowing discharged air to flow in forward and diagonal directions of the door assembly and minimizing the possibility that moisture of humidified air is attached to a lateral surface of the door assembly.

Seventeenth, with respect to the front-rear direction, the outer end of the diffuser outlet may be placed on the same line as the outer end of the vane or the outer end of the diffuser outlet may be placed further inwards than the outer end of the vane, thereby minimizing formation of droplets on a lateral surface of the door assembly, caused by humidified air.

Eighteenth, the outer end of the diffuser outlet may be placed further forwards than the outer end of the vane, thereby minimizing formation of droplets on a lateral surface of the door assembly, caused by humidified air.

Nineteenth, the outer end of the diffuser outlet may be placed further rearwards than the front panel side, thereby increasing a distance between the front panel side and the diffuser outlet and minimizing formation of droplets on a lateral surface of the door assembly, caused by humidified air.

Twentieth, the outer end of the diffuser outlet may be spaced apart from the rear end of the front panel side, a distance D4 is formed between the outer end of the diffuser outlet and the rear end of the front panel side, and the distance D4 is at least 2 mm, thereby ensuring a minimum distance for leftward and rightward movements of the door assembly and for suppressing formation of droplets on a lateral surface of the door assembly.

Twenty first, the diffuser outlet further includes a protrusion that protrudes forwards from the outer end of the diffuser outlet, the protrusion has a length D3, and a total length of D3 and D4 is from 5 mm or more to 10 mm or less, thereby ensuring a distance for suppressing formation of droplets on a lateral surface of the door assembly.

Twenty second, the protrusion of the diffuser outlet may be placed further inwards than an outer surface of the front panel side, and the protrusion of the diffuser outlet and the outer surface of the front panel side form a distance D5 with respect to the left-right direction, thereby ensuring a distance for suppressing formation of droplets on a lateral surface of the door assembly.

Twenty third, the outer end of the diffuser outlet may be placed further rearwards than the front panel side, the outer end of the diffuser outlet may be placed further inwards than the outer surface of the front panel side, and the outer end of the diffuser outlet and the outer surface of the front panel side form the distance, D5, with respect to the left-right direction, thereby ensuring a distance for suppressing formation of droplets on a lateral surface of the door assembly.

BRIEF DESCRIPTION OF THE DRAWINGS

The accompanying drawings constitute a part of this specification and illustrate one or more embodiments of the present disclosure and together with the specification, explain the present disclosure.

DETAILED DESCRIPTION

Figure 1:
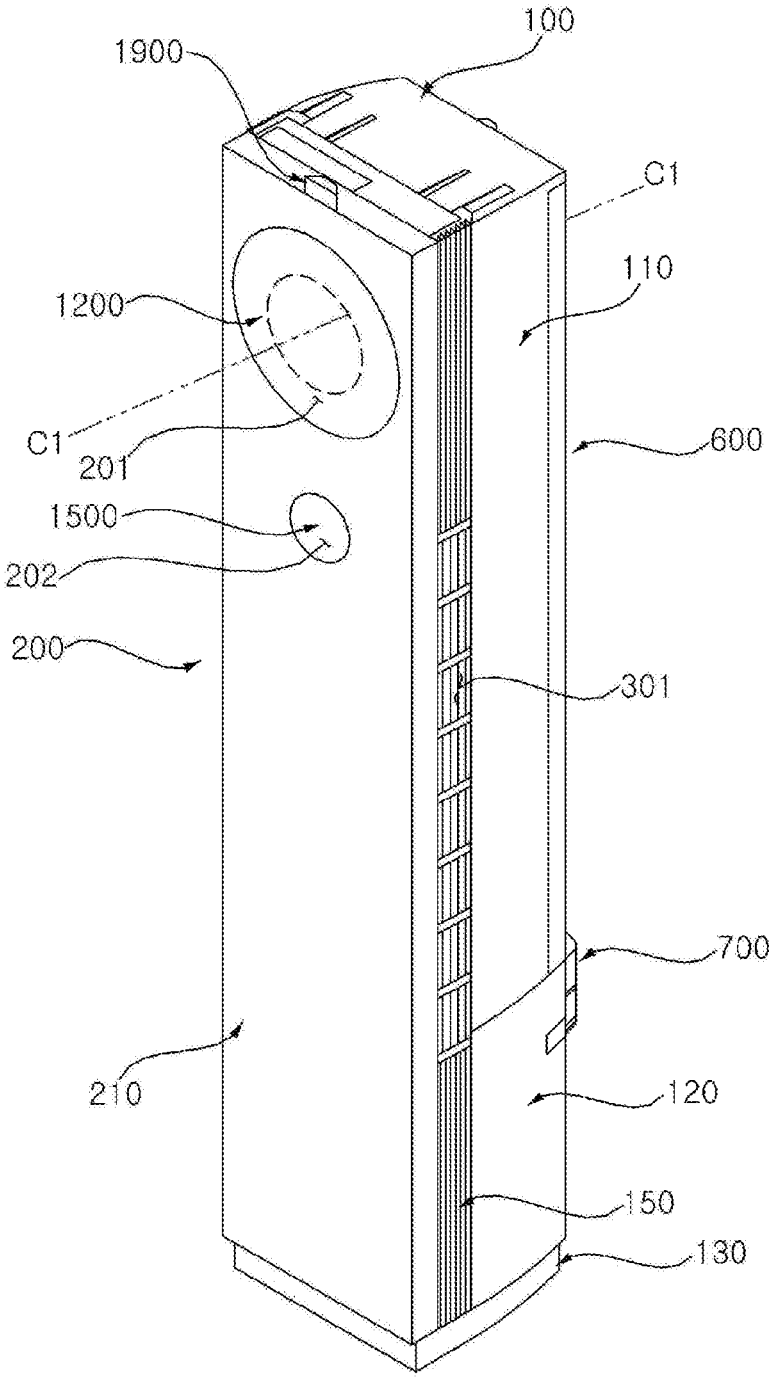
FIG. 1 is a perspective view illustrating a first exemplary indoor unit of an air conditioner.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

As used herein, various singular forms "a," "an" and "the" are intended to include various plural forms as well, unless context clearly indicates otherwise. For example, a term "a" or "an" shall mean "one or more," even though a phrase "one or more" is also used herein. Use of the optional plural "(s)," "(es)," or "(ies)" means that one or more of the indicated feature is present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, features described with respect to certain embodiments may be combined in or with various other embodiments in any permutational or combinatory manner. Different aspects or elements of example embodiments, as disclosed herein, may be combined in a similar manner.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

Figure 2:
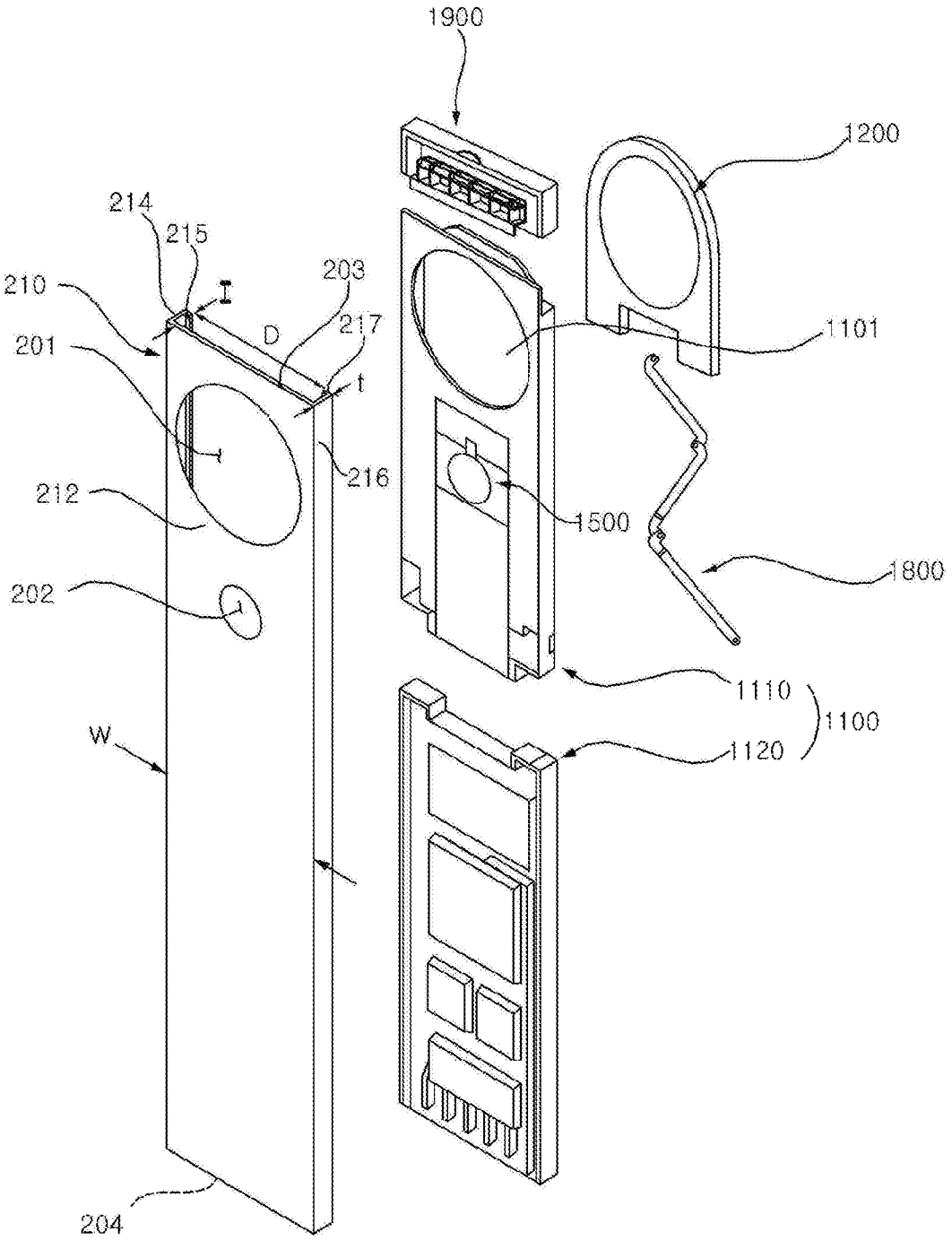
FIG. 2 is an exploded perspective view illustrating the door assembly in FIG. 1.
Figure 3:
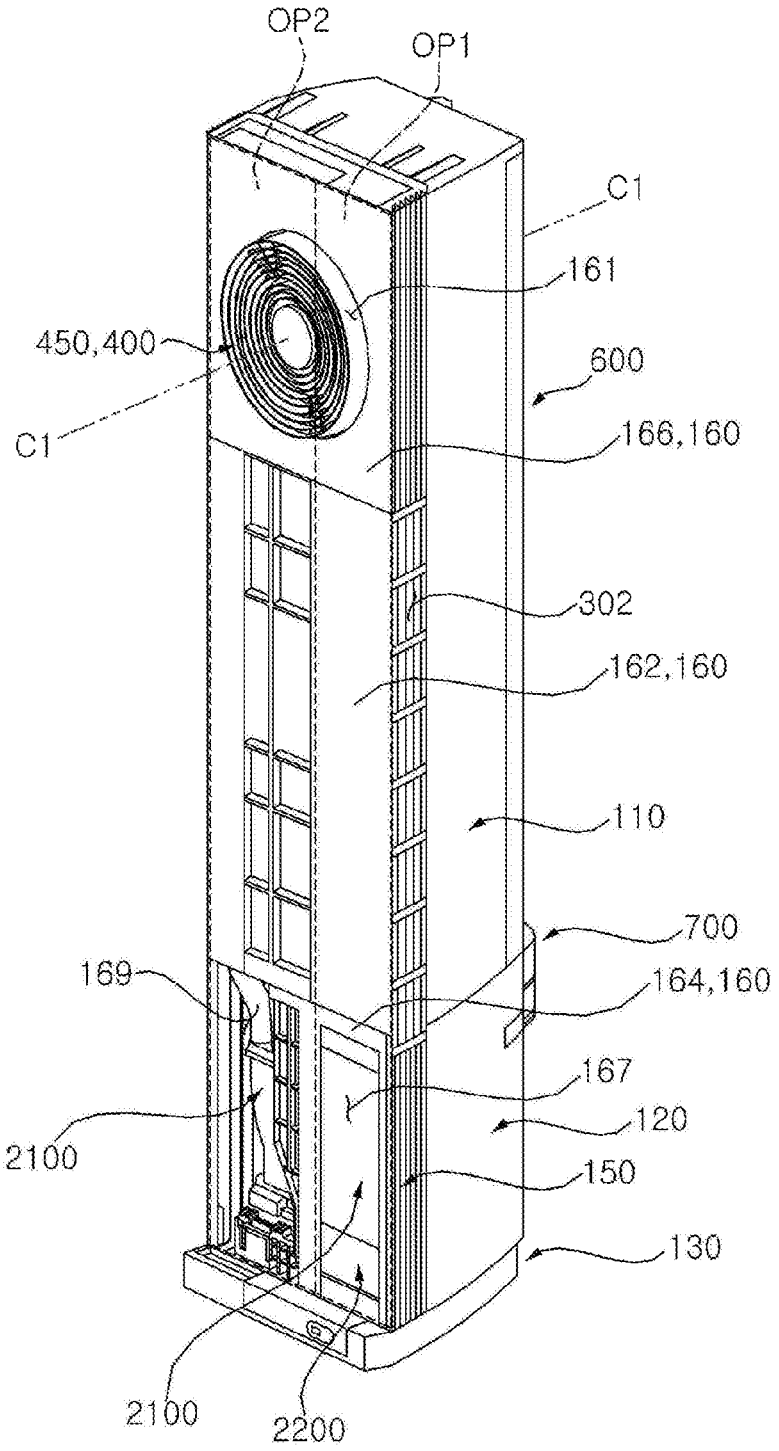
FIG. 3 is a perspective view illustrating a state in which the door assembly is removed from the indoor unit of an air conditioner in FIG. 1.
Figure 4:
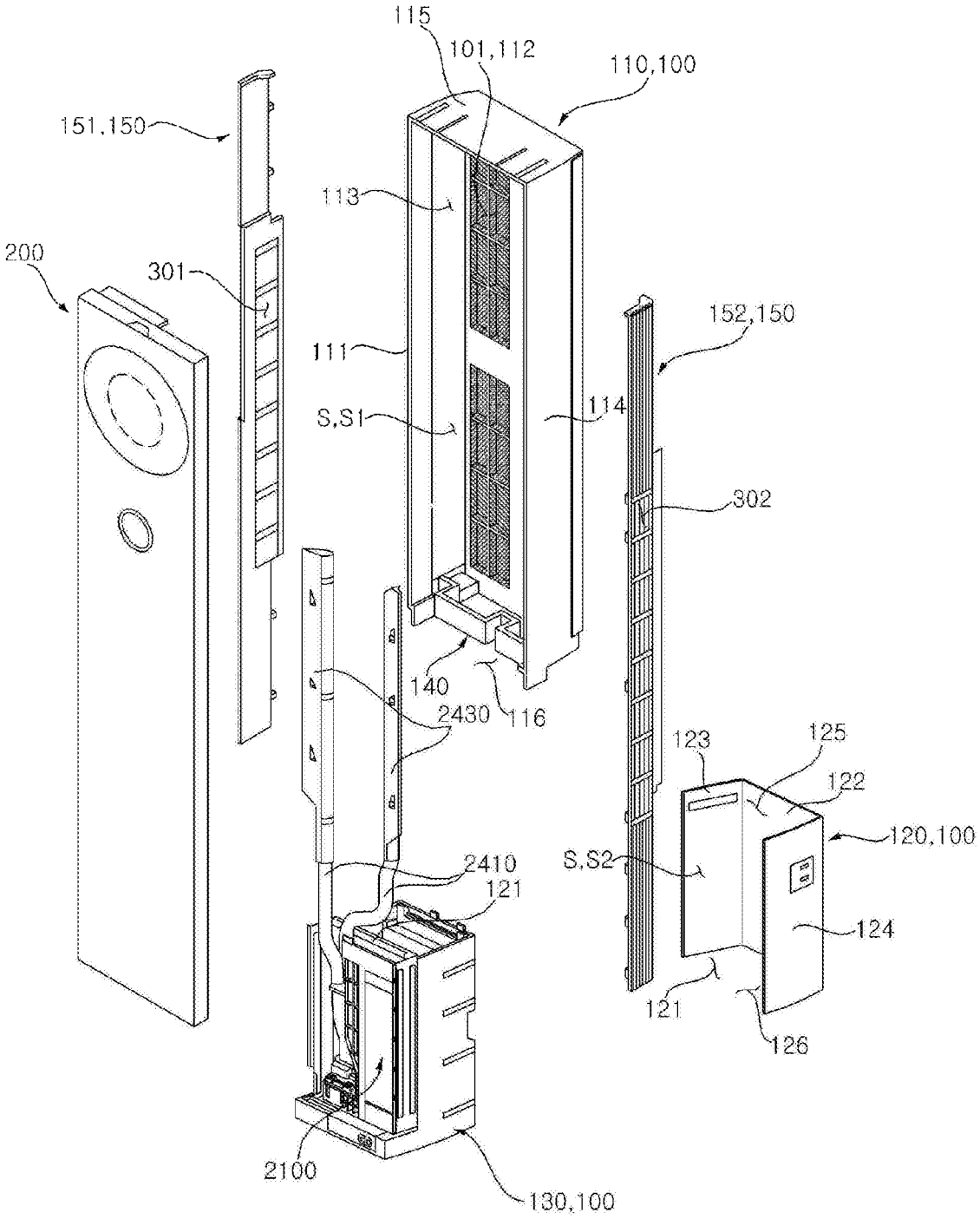
FIG. 4 is an exploded perspective view illustrating the indoor unit of an air conditioner in FIG. 1.

FIG. 1 is a perspective view illustrating a first exemplary indoor unit of an air conditioner. FIG. 2 is an exploded perspective view illustrating the door assembly in FIG. 1. FIG. 3 is a perspective view illustrating a state in which the door assembly is removed from the indoor unit of an air conditioner in FIG. 1. FIG. 4 is an exploded perspective view illustrating the indoor unit of an air conditioner in FIG. 1.

The air conditioner includes an indoor unit and an outdoor unit (not illustrated) that is connected with the indoor unit through a refrigerant pipe and that circulates refrigerants therebetween.

The outdoor unit includes a compressor (not illustrated) that compresses refrigerants, an outdoor heat exchanger (not illustrated) that receives the refrigerants from the compressor and that condenses the refrigerants, an outdoor fan (not illustrated) that supplies air to the outdoor heat exchanger, and an accumulator (not illustrated) that supplies only gaseous refrigerants to the compressor after receiving the refrigerants discharged from the indoor unit.

The outdoor unit may further include a four-way valve (not illustrated) to operate the indoor unit in a cooling mode or a heating mode. When the indoor unit operates in the cooling mode, refrigerants are evaporated in the indoor unit and this action cools the indoor air. When the indoor unit operates in the heating mode, refrigerants are condensed in the indoor unit and this action heats the indoor air.

Configuration of Indoor Unit

The indoor unit includes a cabinet assembly 100 that has an opened front surface and that has an inlet 101 on a rear surface, a door assembly 200 that may be assembled to the cabinet assembly 100, that covers the front surface of the cabinet assembly 100 and that opens and closes the front surface of the cabinet assembly 100, a fan assembly 300, 400 that may be placed in an internal space (S) of the cabinet assembly 100 and that discharges air in the internal space (S) to inner space, a heat exchange assembly 500 that may be placed between the fan assembly 300, 400 and the cabinet assembly 100 and that exchanges heat from indoor air suctioned therein with the heat of refrigerants, a humidification assembly 2000 that may be placed at the cabinet assembly 100 and that supplies moisture to the indoor space, a filter assembly 600 that may be placed on the rear surface of the cabinet assembly 100 and that filters air flowing into the inlet 101, and a moving cleaner 700 that moves upwards and downwards along the filter assembly 600 and that removes foreign substances from the filter assembly 600 and collects the foreign substances.

The indoor unit may include an inlet 101 placed on the rear surface of the cabinet assembly 100, a lateral outlet 301, 302 placed on a lateral surface of the cabinet assembly 100, and a front outlet 201 placed on a front surface of the cabinet assembly 100.

The inlet 101 may be placed on the rear surface of the cabinet assembly 100.

The lateral outlet 301, 302 may be respectively placed on left and right sides of the cabinet assembly 100. In this embodiment, when seen from the front surface of the cabinet assembly 100, a lateral outlet placed on the left side is defined as a first lateral outlet 301, and a lateral outlet placed on the right side is defined as a second lateral outlet 302.

The front outlet 201 is disposed at the door assembly 200, and the door assembly 200 further includes a door cover assembly 1200 that automatically opens and closes the front outlet 201.

The door cover assembly 1200 may move downwards along the door assembly 200 after opening the front outlet 201. The door cover assembly 1200 may move upwards and downwards with respect to the door assembly 200.

After the door cover assembly 1200 moves downwards, a long-distance fan assembly 400 may pass through the door assembly 200 and may move forwards.

The fan assembly 300, 400 may be comprised of a short-distance fan assembly 300 and a long-distance fan assembly 400. The heat exchange assembly 500 may be placed at a rear of the short-distance fan assembly 300 and at a rear of the long-distance fan assembly 400.

The heat exchange assembly 500 may be placed at an inner side of the cabinet assembly 100, and may be placed inside the inlet 101. The heat exchange assembly 500 covers the inlet 101 and may be placed perpendicularly.

The short-distance fan assembly 300 and the long-distance fan assembly 400 are placed at a front of the heat exchange assembly 500. Air suctioned into the inlet 101 passes through the heat exchange assembly 500 and then flows to the short-distance fan assembly 300 and the long-distance fan assembly 400.

The heat exchange assembly 500 may be manufactured to have a length corresponding to the heights of the short-distance fan assembly 300 and the long-distance fan assembly 400.

The short-distance fan assembly 300 and the long-distance fan assembly 400 may be stacked in an up-down direction. In this embodiment, the long-distance fan assembly 400 may be placed at an upper side of the short-distance fan assembly 300. When the long-distance fan assembly 400 is placed at the upper side of the short-distance fan assembly 300, discharged air may flow to a far corner of an indoor space.

The short-distance fan assembly 300 may discharge air laterally with respect to the cabinet assembly 100. The short-distance fan assembly 300 may supply indirect wind to a user. The short-distance fan assembly 300 may discharge air simultaneously to the left side and right side of the cabinet assembly 100.

The long-distance fan assembly 400 may be placed at the upper side of the short-distance fan assembly 300, and may be placed at an inner upper side of the cabinet assembly 100.

The long-distance fan assembly 400 may discharge air forwards with respect to the cabinet assembly 100. The long-distance fan assembly 400 may supply direct wind to the user. Additionally, the long-distance fan assembly 400 may improve circulation of indoor air by discharging air to a far corner of the indoor space.

In this embodiment, the long-distance fan assembly 400 may be exposed to the user only when operating. The long-distance fan assembly 400 may be exposed to the user by passing through the door assembly 200 when the long-distance fan assembly 400 operates. The long-distance fan assembly 400 may be hidden inside the cabinet assembly 100 when the long-distance fan assembly 400 does not operate.

In particular, the long-distance fan assembly 400 may control a discharge direction of air. The long-distance fan assembly 400 may discharge air upwards, downwards, leftwards, rightwards or diagonally with respect to the front surface of the cabinet assembly 100.

The door assembly 200 may be placed at a front of the cabinet assembly 100 and may be assembled to the cabinet assembly 100.

The door assembly 200 may slide in a left-right direction with respect to the cabinet assembly 100, and may expose a part of the front surface of the cabinet assembly 100 outwards.

The door assembly 200 may move in any one of the leftward direction or the rightward direction to open the internal space (S). Additionally, the door assembly 200 may move in any one of the leftward direction or the rightward direction to open only a part of the internal space (S).

In this embodiment, the opening and closing of the door assembly 200 is comprised of two steps.

A first-step opening and closing of the door assembly 200 denotes a partial opening, and may be for water supply of the humidification assembly 2000. The first-step opening and closing of the door assembly 200 denotes exposing a surface area only to the extent that a water tank 2100 of the humidification assembly 2000 may be exposed.

A second-step opening and closing of the door assembly 200 denotes full opening, and may be for installation and repair. To this end, the door assembly 200 includes a door stopper structure that may limit the second-step opening and closing.

The filter assembly 600 may be placed on the rear surface of the cabinet assembly 100. The filter assembly 600 may swivel to a lateral portion of the cabinet assembly 100 in the state of being placed on the rear surface of the cabinet assembly 100. The user may separate only a filter from the filter assembly 600 moved to the lateral portion of the cabinet assembly 100.

In this embodiment, the filter assembly 600 may be comprised of two parts, and each of the parts may swivel leftwards or rightwards.

The moving cleaner 700 may be a device for cleaning the filter assembly 600. The moving cleaner 700 may clean the filter assembly 600 while moving upwards and downwards. The moving cleaner 700 may suction air and may separate foreign substances attached to the filter assembly 600 while moving, and may store the separated foreign substances therein.

The moving cleaner 700 may be installed not to interfere with the filter assembly 600 when the filter assembly 600 swivels.

The humidification assembly 2000 may supply moisture to the internal space (S) of the cabinet assembly 100, and the supplied moisture may be discharged to the indoor space through the short-distance fan assembly. The humidification assembly 2000 includes a detachable water tank 2100.

In this embodiment, the humidification assembly 2000 may be placed at an inner lower side in the cabinet assembly 100. The space in which the humidification assembly 2000 is placed, and the space in which the heat exchange assembly 500 is placed are divided.

The humidification assembly 2000 performs humidification using air filtered through the filter assembly 600 and using sterilized steam. By doing so, harmful substances such as bacteria or fungi are prevented from contacting the water tank.

Configuration of Cabinet Assembly

The cabinet assembly 100 includes a base 130 that may be mounted onto the ground, a lower cabinet 120 that may be placed at an upper side of the base 130, that has an opened front surface 121, an opened upper surface 125 and an opened lower surface 126, and that has a closed left surface 123, a closed right surface 124 and a closed rear surface 122, and an upper cabinet 110 that may be placed an upper side of the lower cabinet 120, that has an opened rear surface 116 on which the inlet 101 may be formed, an opened front surface 111 and an opened lower surface 116, and that has a closed left surface 113, a closed right surface 114 and a closed upper surface 115.

An inside of the upper cabinet 110 is defined as a first internal space (S1), and an inside of the lower cabinet 120 is defined as a second internal space (S2). The first internal space (S1) and the second internal space (S2) constitute the internal space (S) of the cabinet assembly 100.

The short-distance fan assembly 300, the long-distance fan assembly 400, and the heat exchange assembly 500 are placed at an inner side of the upper cabinet 110.

The humidification assembly 2000 may be placed at an inner side of the lower cabinet 120.

A drain pan 140 that supports the heat exchange assembly 500 may be placed between the upper cabinet 110 and the lower cabinet 120. In this embodiment, the drain pan 140 closes a part of a lower surface 116 of the upper cabinet 110.

At the time of assembling the cabinet assembly 100, a lower surface 116 of the upper cabinet 110 may be shielded by the humidification assembly 2000 and the drain pan 140, and air inside the upper cabinet 110 may be prevented from flowing to the lower cabinet 120.

The door assembly 200 may be placed at the front of the cabinet assembly 100, and the door assembly 200 may slide in the left-right direction with respect to the cabinet assembly 100.

When the door assembly 200 moves, a part of the left side or the right side of the cabinet assembly 100 may be exposed outwards.

A side grill 150 may be placed on an edge at a front of the upper cabinet 110. The side grill 150 may be placed at a rear of the door assembly 200.

The side grill 150 may be integrally manufactured with the upper cabinet 110. In this embodiment, the side grill 150 may be additionally manufactured through injection molding and then may be assembled to the upper cabinet 110.

A discharge grill placed at a front of the left surface 113 is defined as a left side grill 151, and a discharge grill placed at a front of the right surface 114 is defined as a right side grill 152.

From a top view perspective, the left side grill 151 and the right side grill 152 are symmetrical in the left-right direction with respect to a central axis (C1).

A lateral outlet 301, 302 are respectively formed at the left side grill 151 and the right side grill 152. Each of the lateral outlets 301, 302 are formed to pass through the left side grill 151 and the right side grill 152.

A plurality of vanes 155 are placed in the up-down direction at each of the side grills 151, 152. Each of the vanes 155 may be formed to extend in the up-down direction.

The plurality of vanes 155 (see FIG. 13) are placed at regular intervals in a front-rear direction. Each of the vanes 155 forms a vane gap (BG) (see FIG. 15).

In this embodiment, a cover 160 is placed at the front of the upper cabinet 110 and the lower cabinet 120, and blocks air inside the cabinet 100 from directly contacting the door assembly 200.

When cold air directly contacts the door assembly 200, droplets may be formed, and electric circuits constituting the door assembly 200 may be adversely affected.

When the cover 160 is placed at the front of the upper cabinet 110 and the lower cabinet 120, air in the cabinet 100 may flow through the cover 160 only to the front outlet 201 or the lateral outlet 301, 302.

The cover 160 includes an upper cover 162 that covers a front surface of the upper cabinet 110, a lower cover 164 that covers a front surface of the lower cabinet 120, and a long-distance fan cover 166 that covers a front surface of the long-distance fan assembly 400.

The long-distance fan cover 166 may be integrally manufactured with the upper cover 162. In this embodiment, the long-distance fan cover 166 and the upper cover 162 are individually manufactured and then assembled.

The long-distance fan cover 166 may be placed at a front of the long-distance fan assembly 400 and may be placed at an upper side of the upper cover 162. Front surfaces of the long-distance fan cover 166 and the upper cover 162 form an extended flat surface.

The long-distance fan cover 166 includes a fan cover outlet 161 that is opened in the front-rear direction. The fan cover outlet 161 communicates with the front outlet 201 and may be placed at a rear of the front outlet 201. A discharge grill 450 of the long-distance fan assembly 400 may move to the front of the door assembly 200 by passing through the fan cover outlet 161 and the front outlet 201.

The door assembly 200 may be placed at a front of the fan cover outlet 161 and the fan cover outlet 161 may be placed at a rear of a below-described panel outlet 1101. When the long-distance fan assembly 400 moves forwards, the discharge grill 450 consecutively passes through the fan cover outlet 161, the panel outlet 1101, and the front outlet 201.

That is, the panel outlet 1101 may be placed at a rear of the front outlet 201, and the fan cover outlet 161 may be placed at a rear of the panel outlet 1101.

The long-distance fan cover 166 may be coupled to an upper side of the front of the upper cabinet 110, and the upper cover 162 may be coupled to a lower side of the front of the upper cabinet 110.

The lower cover 164 may be placed at a lower side of the upper cover 162, and may be assembled to the lower cabinet 120 or the humidification assembly 2000. After the assembly, front surfaces of the lower cover 164 and the upper cover 162 form an extended surface.

The lower cover 164 includes a water tank opening 167 that may be opened in the front-rear direction. The water tank 2100 may be detached or mounted through the water tank opening 167.

The lower cover 164 may be placed at a lower side of a front of the drain pan 140. Air inside the upper cabinet 110 does not leak even without entirely covering the front surface of the lower cabinet 120. Accordingly, the front surface of the lower cabinet 120 does not have to be entirely covered.

A part of the front surface of the lower cabinet 120 is preferably opened for repairs, service provisions, and replacements to the humidification assembly 2000. In this embodiment, a part of the front surface of the lower cabinet 120 includes an opened surface 169 that is not shielded by the lower cover 164.

At the time of a first-step opening of the door assembly 200, the lower cover 164 at which the water tank opening 167 is formed is only exposed to the user, and, at the time of a second-step opening of the door assembly, the opened surface 169 may be also exposed to the user.

The door assembly 200 slides in the left-right direction by operations of a door slide module 1300. A state in which the water tank opening 167 may be entirely exposed by a sliding movement of the door assembly 200 is defined as the first-step opening, and a state in which the opened surface 169 may be exposed is defined as a second-step opening.

A front surface of the cabinet assembly 100, which may be exposed at the time of the first-step opening, is defined as a first opened surface (OP1), and a front surface of the cabinet assembly, which may be exposed at the time of the second-step opening, is defined as a second opened surface (OP2).

«Configuration of Short-Distance Fan Assembly»

The short-distance fan assembly 300 is a configuration for discharging air laterally with respect to the cabinet assembly 100. The short-distance fan assembly 300 supplies indirect wind to the user.

The short-distance fan assembly 300 may be placed at the front of the heat exchange assembly 500.

As for the short-distance fan assembly 300, a plurality of fans 310 are stacked and installed in the up-down direction. In this embodiment, three fans 310 are provided and are stacked in the up-down direction.

In this embodiment, a mixed-flow type centrifugal fan may be used as the fan 310. The fan 310 suctions air axially and discharges air circumferentially.

The fan 310 discharges air circumferentially and forwards after suctioning the air from the rear. The fan 310 discharges air currents having directivity toward the front while discharging air circumferentially.

The short-distance fan assembly 300 includes a fan casing 320 that may be formed to have an opened front and an opened rear and that may be coupled to the cabinet assembly 100, a plurality of fans 310 that may be coupled to the fan casing 320 and that are placed in the fan casing 320, and a fan guide 330 that may be coupled to the fan casing 320 and that guides the air discharged to the fan 310 laterally with respect to the cabinet assembly 100.

The fan casing 320 may be manufactured to have a box shape that has an opened front surface and an opened rear surface. The fan casing 320 may be coupled to the cabinet assembly 100.

A front surface of the fan casing 320 may be placed to face the door assembly 200. A rear surface of the fan casing 320 may be placed to face the heat exchange assembly 500.

The front surface of the fan casing 320 comes into close contact with the door assembly 200, and is closed.

In this embodiment, a part of a lateral surface of the fan casing 320 may be exposed outwards. The lateral outlet 301, 302 may be formed at the fan casing 320 that may be exposed outwards. The side grill 151, 152 that may control a discharge direction of air may be placed at the lateral outlet 301, 302. The lateral outlet 301, 302 may be placed respectively on a left side and a right side of the fan casing 320.

The fan 310 may be placed in the fan casing 320. The plurality of fans 310 are placed on the same flat surface and are stacked in line with respect to the up-down direction.

A centrifugal fan may be used as the fan 310. Accordingly, the fan 310 suctions air from the rear surface of the fan casing 320, and then discharges the air circumferentially.

The fan guide 330 guides the air discharged from the fan 310 to the lateral outlet 301, 302. A centrifugal fan may be used as the fan 310. Accordingly, air discharged upwards and downwards may be guided to the lateral outlet 301, 302 by the fan guide 330.

Configuration of Fan

Figure 13:
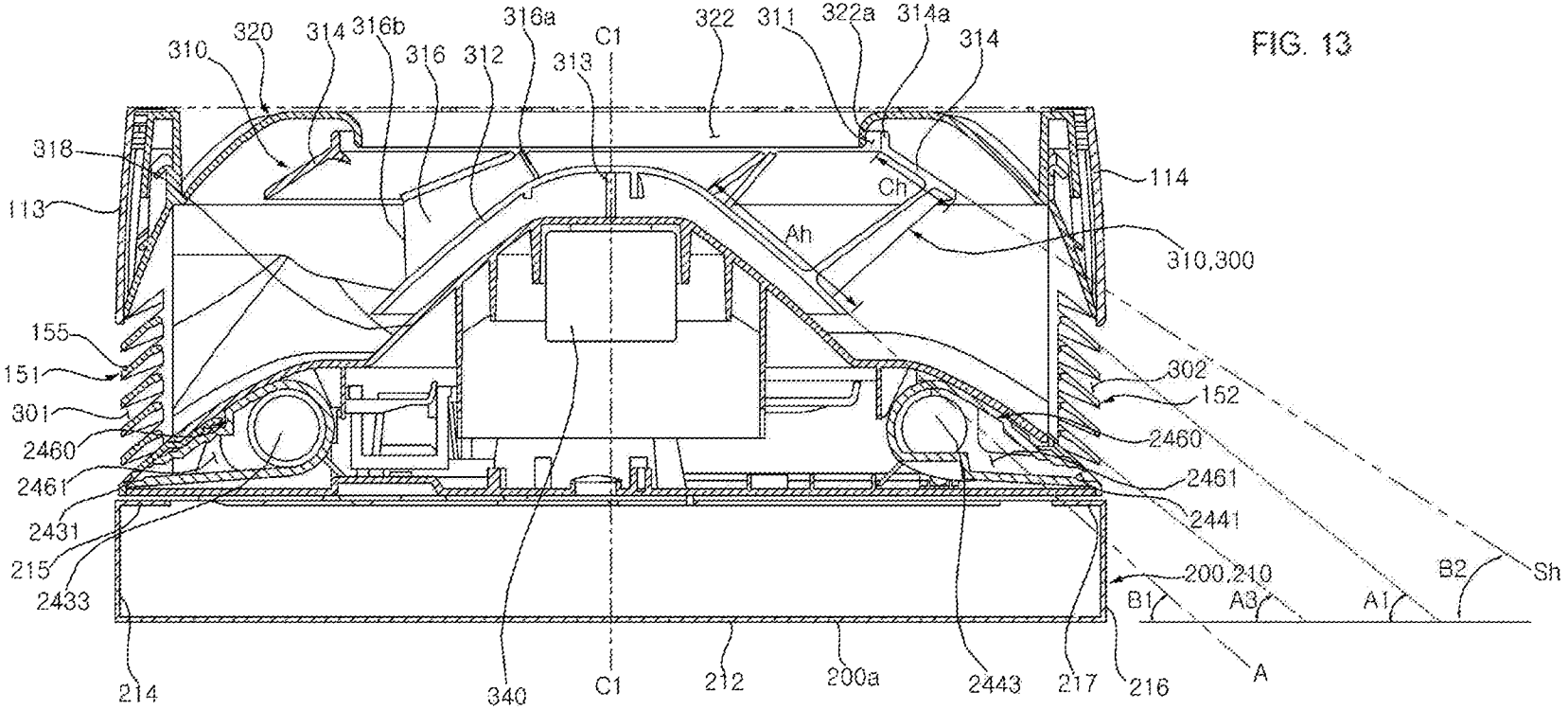
FIG. 13 is an exemplary view in which the diffuser in FIG. 6 is installed.

As shown in FIG. 13, fan 310 includes a hub 312 that has a center to which a rotating shaft 313 may be coupled, a shroud 314 that may be spaced apart from the hub 312 and that includes an inlet 311, into which air may be suctioned, at a central portion thereof, and a plurality of blades 316 placed between the hub 312 and the shroud 314.

A plurality of blades 316 are provided between the hub 312 and the shroud 314. A front end of the blade 316 may be coupled to a rear surface of the hub 312, and a rear end of the blade 316 may be coupled to a front surface of the shroud 314. The plurality of blades 316 are spaced apart circumferentially. A cross section of the blade 316 preferably has an airfoil shape.

A lateral end of the blade 316, into which air is introduced, is referred to as a leading edge 316*a*, and a lateral end of the blade 316, into which air may be discharged, is referred to as a trailing edge 316*b*.

The trailing edge 316*b* of the blade 316 may be formed at a slant with respect to the front-rear direction such that discharged air travels in a radial direction toward the front at a slant. The leading edge 316*a* of the blade 316 may be shorter than the trailing edge 316*b* of the blade 316 such that discharged air faces from the radial direction to the front at a slant.

The hub 312 has a cone shape that protrudes downwards toward the center. A rear of a motor cover 318 may be inserted into a front of the hub 312, and at least part of a fan motor 340 may be placed in the hub 312. With this structure, a front-rear width, occupied by the fan motor 340 and the fan 310, may be minimized.

The rotating shaft 313 of the fan motor 340, placed at an upper side of the hub 312, may be coupled to the center of the hub 312. The hub 312 may be placed at a front side of the shroud 314, and the hub 312 and the shroud 314 are spaced apart. The plurality of blades 316 are coupled to the rear surface of the hub 312.

From a top view perspective, the rotating shaft 313 is preferably placed at the center from the left and right of the cabinet assembly 100. From a top view perspective, the rotating shaft 313 may be placed on the central axis (C1) line that penetrates the center of the front outlet in the front-rear direction.

An outer circumferential end of the hub 312 may be formed to face at a slant in a direction opposite to a direction of the inlet 311. The outer circumferential end of the hub 312 denotes a perimeter of a front end of the hub 312. A direction (A) faced by the outer circumferential end of the hub 312 is preferably at approximately 45 degrees from the left-right direction. The outer circumferential end of the hub 312 may be formed to face forwards at a slant such that air is discharged forwards at a slant.

A flat cross section of the hub 312 may be formed in a straight line shape (Ah) that is inclined from a central portion to the outer circumferential end of the hub 312 in a direction opposite to a direction of the inlet 311. Preferably, a longitudinal cross section of the hub 312 is formed in a straight line shape (Ah) that is inclined from a portion to which the leading edge 316*a* of each of the plurality of blades 316 may be connected to the outer circumferential end. A diameter of the hub 312 may be formed to regularly increase from the central portion to the outer circumferential end. Preferably, the diameter of the hub 312 is formed to regularly increase from the portion to which the leading edge 316*a* of each of the plurality of blades 316 may be connected to the outer circumferential end.

The shroud 314 may be formed in a bowl shape that includes a circular inlet 311 into which air is suctioned at a central portion. The inlet 311 of the shroud 314 may be placed to face the inlet 101 of the cabinet assembly 100.

That is, an inlet 322 of the fan casing 320 may be formed at a portion corresponding to a portion of the inlet 311 of the shroud 314. A diameter of the inlet 311 is preferably greater than a diameter of the inlet 322 of the fan casing 320. The shroud 314 includes a suction guide 314*a* that protrudes perpendicularly rearwards at a perimeter portion of the inlet 311.

The shroud 314 may be spaced apart from the rear of the hub 312.

The plurality of blades 316 are coupled to a front surface of the shroud 314.

The shroud 314 may be formed such that an outer circumferential end of the shroud 314 faces at a slant in a direction opposite to the direction of the inlet 311. The outer circumferential end of the shroud 314 denotes a perimeter of a leading end of the shroud 314. A direction (Sh) faced by the outer circumferential end of the shroud 314 is preferably at approximately 45 degrees from a horizontal direction. The outer circumferential end of the shroud 314 may be formed to incline forwards such that air is discharged forwards at a slant. Preferably, the direction faced by the outer circumferential end of the shroud 314 is substantially in parallel with the direction faced by the outer circumferential end of the hub 312.

A longitudinal cross section of the shroud 314 may be formed in a straight line shape (Ch) that is inclined from an upper end of the suction guide 314*a* to the outer circumferential end of the shroud 314 in a direction opposite to the direction of the inlet 311. Preferably, the longitudinal cross section of the shroud 314 is formed in a straight line shape (Ch) that is inclined from a portion to which a leading edge 24*b*-1 of each of the plurality of blades 316 may be connected to the outer circumferential end. A diameter of the shroud 314 may be formed to increase on a regular basis from the upper end of the suction guide 314*a* to the outer circumferential end. Preferably, the diameter of the shroud 314 is formed to increase on a regular basis from the portion to which the leading edge 316*a* of each of the plurality of blades 316 may be connected to the outer circumferential end.

Preferably, the direction (Sh) faced by the outer circumferential end of the shroud 314 is substantially in parallel with the direction (A) faced by the outer circumferential end of the hub 312. Preferably, the inclined straight line (Ch) portion of the longitudinal cross section of the shroud 314 is substantially in parallel with the inclined straight line (Ah) portion of the longitudinal cross section of the hub 312.

In this embodiment, a gap between the shroud 314 and the hub 312 may be formed to become gradually wider towards the outer circumferential ends.

Configuration of Long-Distance Fan Assembly

The long-distance fan assembly 400 is a configuration for discharging air forwards with respect to the cabinet assembly 100. The long-distance fan assembly 400 supplies air directly to the user.

The long-distance fan assembly 400 may be placed at the front of the heat exchange assembly 500. The long-distance fan assembly 400 may be stacked at the upper side of the short-distance fan assembly 300.

The long-distance fan assembly 400 discharges air to the front outlet 201 formed at the door assembly 200. The long-distance fan assembly 400 has a structure that may rotate upwards, downwards, leftwards, rightwards, or diagonally. The long-distance fan assembly 400 may improve circulation of indoor air by discharging air to a far corner of the indoor space.

The long-distance fan assembly 400 includes a fan base 410 that has a fan inlet 411, into which air having passed through the heat exchange assembly 500 is suctioned, at a rear surface thereof, a fan 420 that may be placed at a front of the fan base 410 and that discharges the air suctioned by the fan inlet 411 in a mixed-flow direction, a fan housing 430 that may be placed at the front of the fan base 410, that may be coupled to the fan base 410 and that guides air pressurized by the fan 420 forwards, a fan motor 440 that may be installed at the fan housing 430 and that may be connected with the fan 420 through a motor shaft to rotate the fan 420, a discharge grill 450 that may be placed at a front of the fan housing 430 and that controls a discharge direction of the air guided through the fan housing 430, a guide housing 460 that may be coupled to any one of the fan casing 320 or the cabinet assembly 100 and that guides forward and rearward movements of the fan housing 430, and a fan housing actuator 470 that supplies drive force when the fan housing 430 moves.

The fan base 410, the fan 420, the fan housing 430, and the fan motor 440 that are assembled as a single structure are defined as a fan housing assembly.

The long-distance fan assembly 400 may further include a tilting assembly that relatively rotates the discharge grill 450 with respect to the fan housing assembly freely in all directions including an upward direction, a downward direction, a leftward direction, a rightward direction, a diagonal direction and the like.

Configuration of Door Assembly

The door assembly 200 includes a front panel 210 at which the front outlet 201 may be formed, a panel module 1100 that may be coupled to a rear surface of the front panel 210 and at which a panel outlet 1101 communicating with the front outlet 201 may be formed, a door cover assembly 1200 that may be placed at the panel module 1100 and that opens and closes the panel outlet 1101 and the front outlet 201, a door slide module 1300 that may be placed at the panel module 1100 and that moves the panel module 1100 with respect to the cabinet assembly 100 in the left-right direction, a camera module 1900 that may be placed at an upper side of the panel module 1100 and that captures images of indoor space, and a cable guide 1800 the upper end of which may be assembled to the door cover assembly 1200 in a relatively rotatable manner, the lower end of which may be assembled to the panel module assembly 1100 in a relatively rotatable manner and in which a cable connected to the door cover assembly 1200 may be stored.

The door assembly 200 may move in the left-right direction with respect to the cabinet assembly.

The front outlet 201 may be placed at the front panel 210 and may be opened in the front-rear direction. The panel outlet 1101 may be placed at the panel module 1100 and may be opened in the front-rear direction.

Surface areas and shapes of the front outlet 201 and the panel outlet 1101 are the same. The front outlet 201 may be placed further forwards than the panel outlet 1101.

Additionally, the door assembly 200 may be placed at the panel module 1100, and may further include a display module 1500 that supplies information of the indoor unit to the front panel 210 visually.

The display module 1500 may be placed on the rear surface of the front panel 1100, and may supply visual information to the user by passing through the front panel 1100.

Additionally, a part of the display module 1500 may be exposed by passing through the front panel 1100, and the display module may also supply visual information to the user through an exposed display.

In this embodiment, information of the display module 1500 may be delivered to the user through a display opening 202 formed at the front panel 210.

Configuration of Front Panel

The front panel 210 may be placed on a front surface of the indoor unit. The front panel 210 may include a front panel body 212, a front outlet 201 that is opened in the front-rear direction of the front panel body 212, a display opening 202 that is opened in the front-rear direction of the front panel body 212, a first front panel side 214 that may be placed on a left side of the front panel body 212 and that covers a left surface of the panel module 1100, and a second front panel side 216 that may be placed on a right side of the front panel body 212 and that covers a right surface of the panel module 1100.

An up-down length of the front panel 210 may be much greater than a left-right width of the front panel 210. In one embodiment, the up-down length of the front panel 210 is three times or more greater than the left-right width of the front panel 210. Additionally, a front-rear thickness of the front panel 210 may be much smaller than the left-right width of the front panel 210. In one embodiment, the front-rear thickness of the front panel 210 is smaller than or equal to one fourth of the left-right width of the front panel 210.

In this embodiment, the display opening 202 may be placed at a lower side of the front outlet 201. Unlike the display opening 202 of this embodiment, the display opening 202 may be placed at an upper side of the front outlet 201.

The front outlet 201 and the display opening 202 are arranged in the up-down direction. A virtual central axis (C1) that connects a center of the front outlet 201 and a center of the display opening 202 is perpendicularly placed. With respect to the central axis (C1), the front panel 210 may be symmetrical in the left-right direction.

A camera 1950 of the camera module 1900 may be placed on the central axis (C1).

The front outlet 201 may have a circular shape. The shape of the front outlet 201 corresponds to a shape of a front surface of a steering grill 3450. The steering grill 3450 hidden in the cabinet assembly 100 may be exposed outwards through the front outlet 201.

In this embodiment, the front outlet 201 is optionally opened and exposes the steering grill 3450. In addition, the steering grill 3450 passes through the front outlet 201 and protrudes further forwards than the front panel 210.

When the steering grill 3450 protrudes further forwards than the front panel 210, interference between air having passed through the steering grill 3450 and the front panel 210 may be minimized, and discharged air may flow farther away.

The first front panel side 214 protrudes rearwards from a left edge of the front panel body 212 and covers the left surface of the panel module 1100 fixed on a rear surface of the front panel body 212.

The second front panel side 216 protrudes rearwards from a right edge of the front panel body 212 and covers the right surface of the panel module 1100 fixed on the rear surface of the front panel body 212.

The first front panel side 214 and the second front panel side 216 prevent the lateral surfaces of the panel module 1100 from being exposed outwards.

Additionally, a first front panel end 215 that protrudes toward the second front panel side 216 from an end at a rear of the first front panel side 214 may be further placed. A second front panel end 217 that protrudes toward the first front panel side 214 from an end at a rear of the second front panel side 216 may be further placed.

The first front panel end 215 and the second front panel end 217 are placed on a rear surface of the panel module 1100. That is, the panel module 1100 may be placed between the front panel body 212 and the front panel end 215, 217.

In this embodiment, a gap between the front panel body 212 and the front panel end 215, 217 is defined as an inner gap (I) of the front panel. The inner gap (I) may be narrower than a front-rear width of the front panel 210.

Additionally, the first front panel end 215 and the second front panel end 217 are placed to face each other and are spaced apart from each other. In this embodiment, a gap between the first front panel end 215 and the second front panel end 217 is defined as an opened gap (D) of the front panel. The opened gap (D) of the front panel 210 may be narrower than the left-right width (W) of the front panel 210.

In this embodiment, the front panel body 212 and the front panel end 215, 217 are placed in parallel. The front panel body 212 and the front panel side 214, 216 are crossed, and, in this embodiment, are orthogonally placed. The front panel side 214, 216 may be placed in the front-rear direction.

In this embodiment, the front panel body 212, the front panel side 214, 216, and the front panel end 215, 217 that constitute the front panel 210 are integrally manufactured.

In this embodiment, the front panel 210 may be entirely made of a metallic material. In particular, the front panel 210 may be entirely made of aluminum.

Accordingly, the front panel side 214, 216 may be bent rearwards from the front panel body 212, and the front panel end 215, 217 may be bent forwards from the front panel side 214, 216.

In order for the front panel 210, which may be entirely made of a metallic material to be readily bent, a first bending groove (not illustrated) may be formed at a bent portion between the front panel body 212 and the first front panel side 214, and a second bending groove 213*a* may be formed at a bent portion between the front panel body 212 and the second front panel side 216.

Additionally, a third bending groove (not illustrated) may be formed at a bent portion between the first front panel side 214 and the first front panel end 215, and a fourth bending groove 213*b* may be formed at the bent portion between the second front panel side 216 and the second front panel end 217.

Each of the bending grooves may be formed to extend vertically in a lengthwise direction of the front panel 210. Each of the bending grooves is preferably placed inside the bent portions. When the first bending groove and the second bending groove 213*a* are not formed, it may be difficult to form an angle between the front panel body 212 and the front panel side into a right angle. Additionally, when the first bending groove and the second bending groove 213*a* are not formed, the bent portion between the front panel body 212 and the front panel side may not be flat, and, during a bending process, may protrude or may be deformed in any direction. The third bending groove and the fourth bending groove 213*b* perform the same function as the first bending groove and the second bending groove 213*a*.

The front panel 210 that is manufactured as described above includes a panel upper opening 203 and a panel lower opening 204 respectively at an upper side thereof. In this embodiment, a single metallic plate is bent to manufacture the front panel 210. Accordingly, the panel upper opening 203 and the panel lower opening 204 are formed to have the same surface area and the same shape.

A thickness of the panel module 1100 may be the same as or smaller than a gap between the front panel body 212 and the front panel end 215, 217. The panel module 1100 may be inserted through the panel upper opening 203 or the panel lower opening 204. The panel module 1100 may be fixed by a coupling member (not illustrated) that passes through the front panel end 215, 217.

The camera module 1900 may be inserted into the panel upper opening 203 and may be placed at the upper side of the panel module 1100. The camera module 1900 may close the panel upper opening 203.

The camera module 1900 may be placed at the upper side of the front outlet 201 and may be placed on a rear surface of the front panel 210. The camera module 1900 may be hidden by the front panel 210. The camera module 1900 may be exposed to the upper side of the front panel 210 only when operating, and may be hidden behind the rear surface of the front panel 210 when not operating.

The front panel end 215, 217 wraps lateral surfaces and a rear surface of the camera module 1900, and a coupling member (not illustrated) passes through the front panel end 215, 217 and may be coupled to the camera module 1900.

In this embodiment, a left-right width of the panel upper opening 203 is formed to be the same as a left-right width of the camera module 1900. Additionally, in this embodiment, the left-right width of the panel upper opening 203 is formed to be the same as a left-right width of the panel module 1100.

In this embodiment, a front-rear thickness of the panel upper opening 203 is formed to be the same as a front-rear thickness of the camera module 1900. Additionally, in this embodiment, the front-rear thickness of the panel upper opening 203 is also formed to be the same as a front-rear thickness of the panel module 1100.

Accordingly, the camera module 1900 and the panel module 1100 may be placed between the front panel body 212 and the front panel end 215, 217, and may be supported by the front panel body 212 and the front panel end 215, 217.

Figure 5:
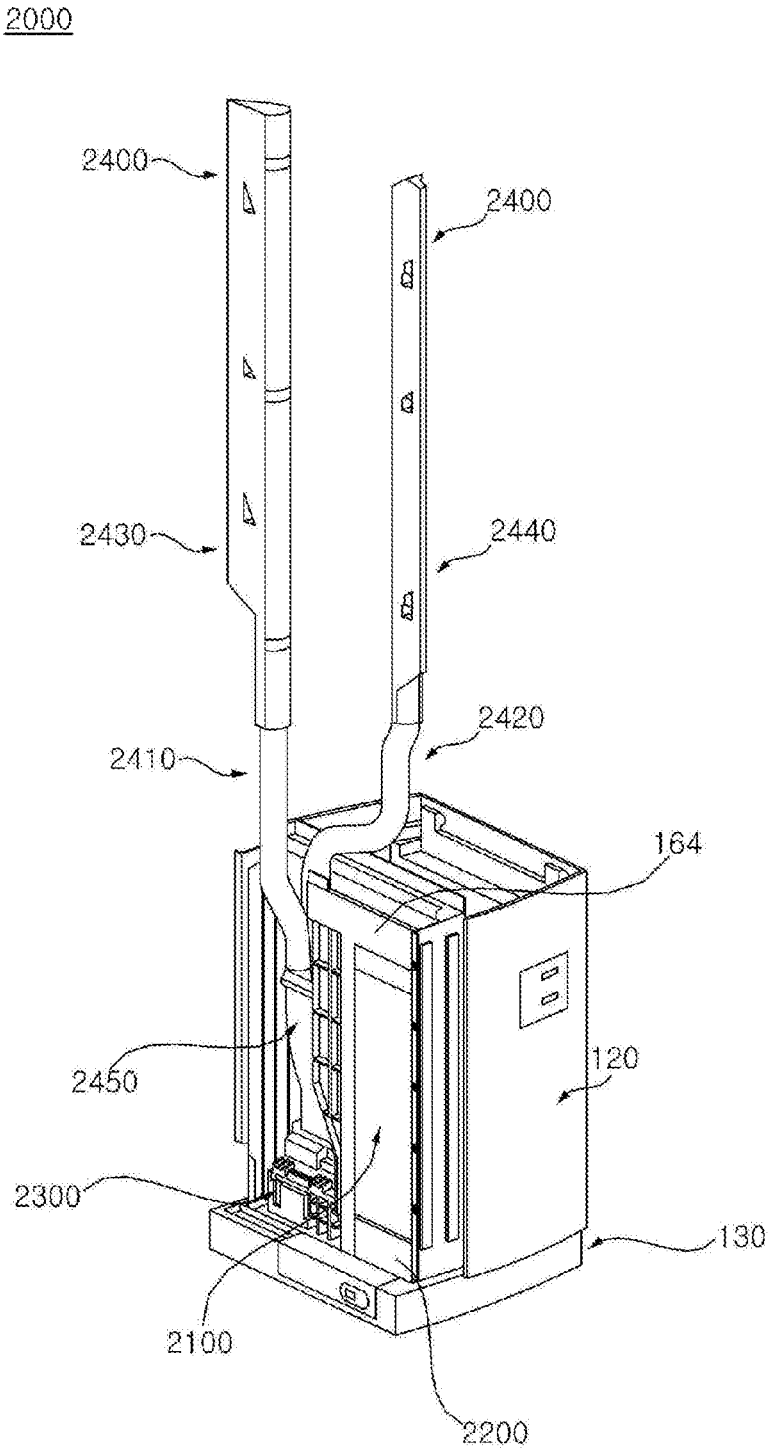
FIG. 5 is a perspective view illustrating the humidification assembly and the water tank in FIG. 4 assembled to a lower cabinet.
Figure 6:
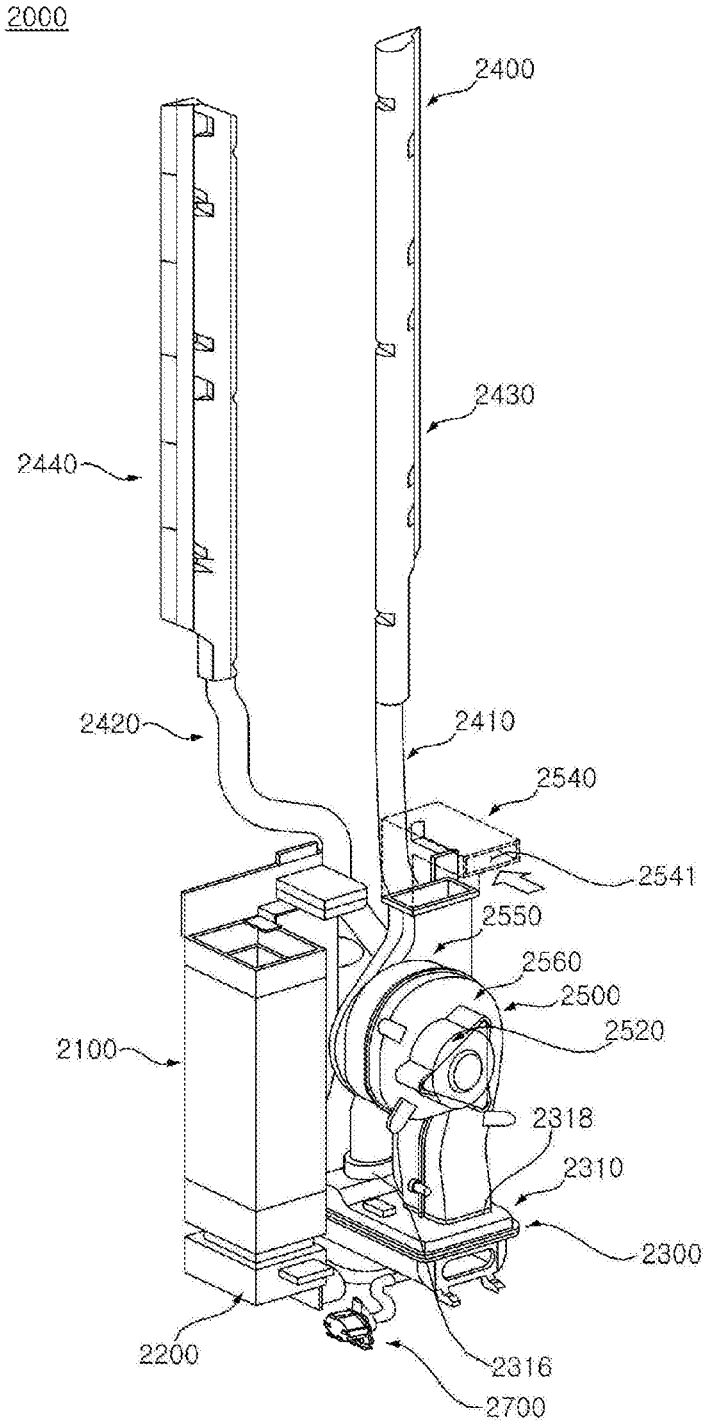
FIG. 6 is a perspective view illustrating a rear of a first exemplary humidification assembly.
Figure 7:
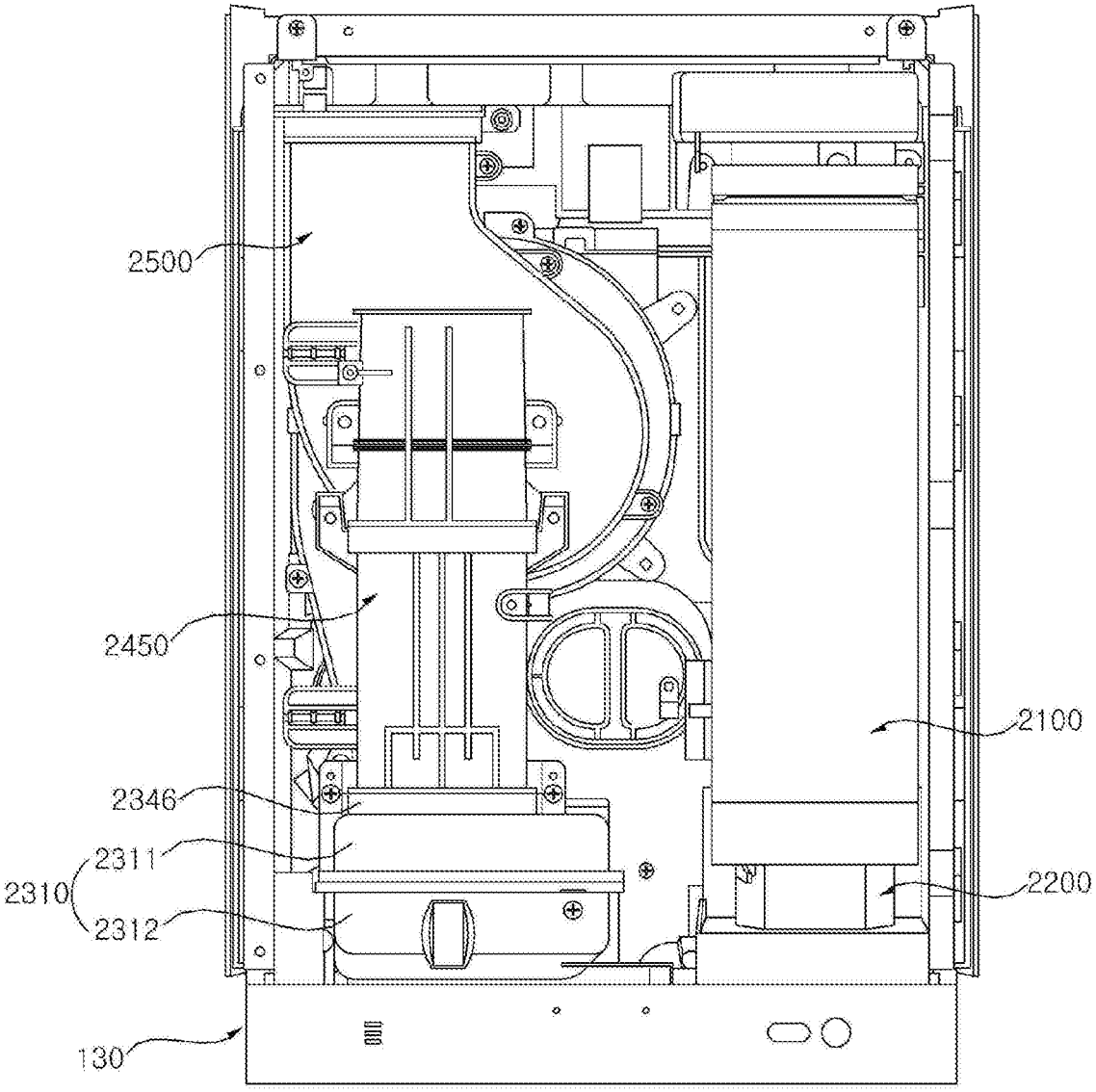
FIG. 7 is a front view illustrating an inside of the lower cabinet in FIG. 3.
Figure 8:
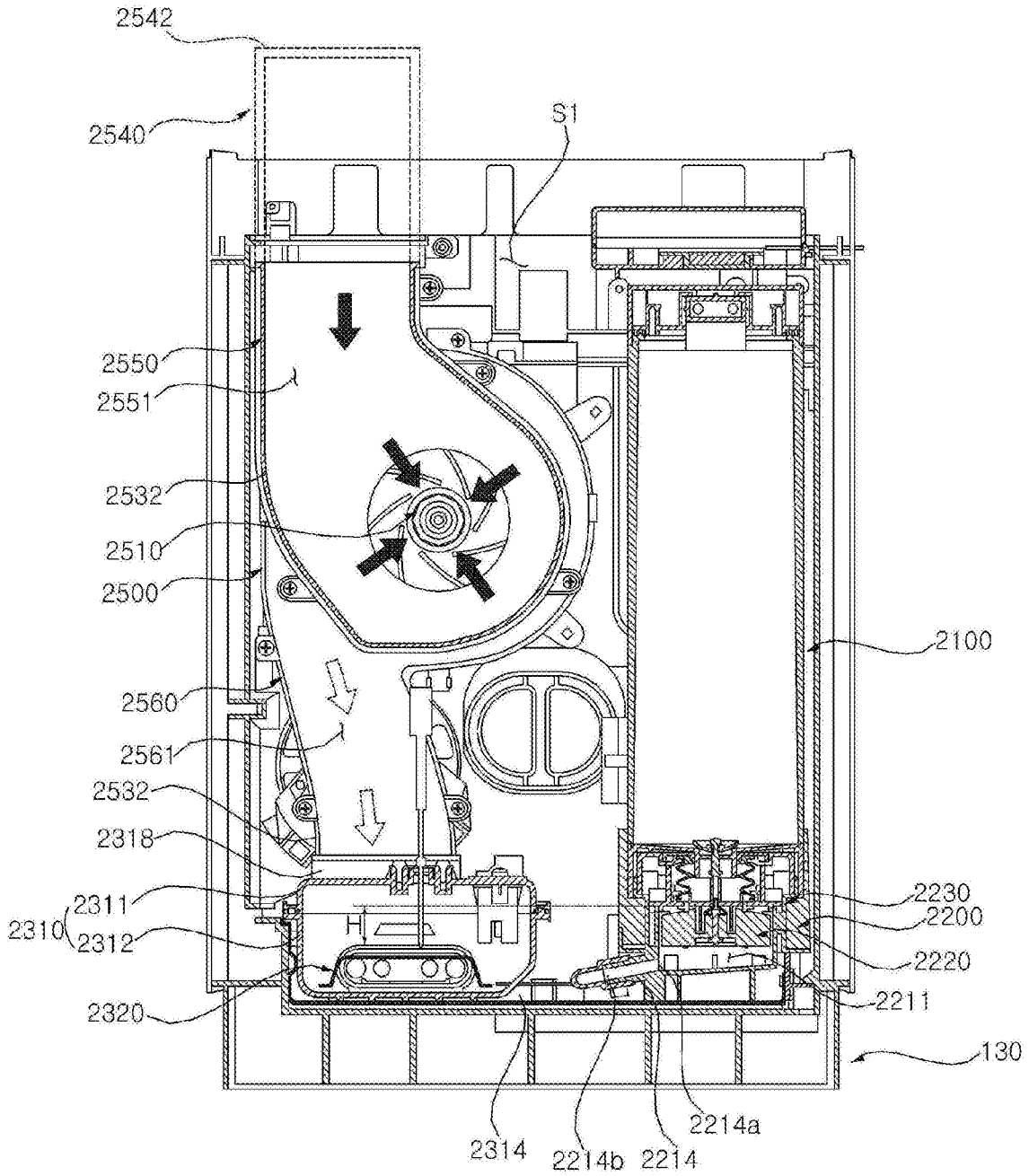
FIG. 8 is a cross-sectional view illustrating the humidification assembly and the water tank in FIG. 7.
Figure 9:
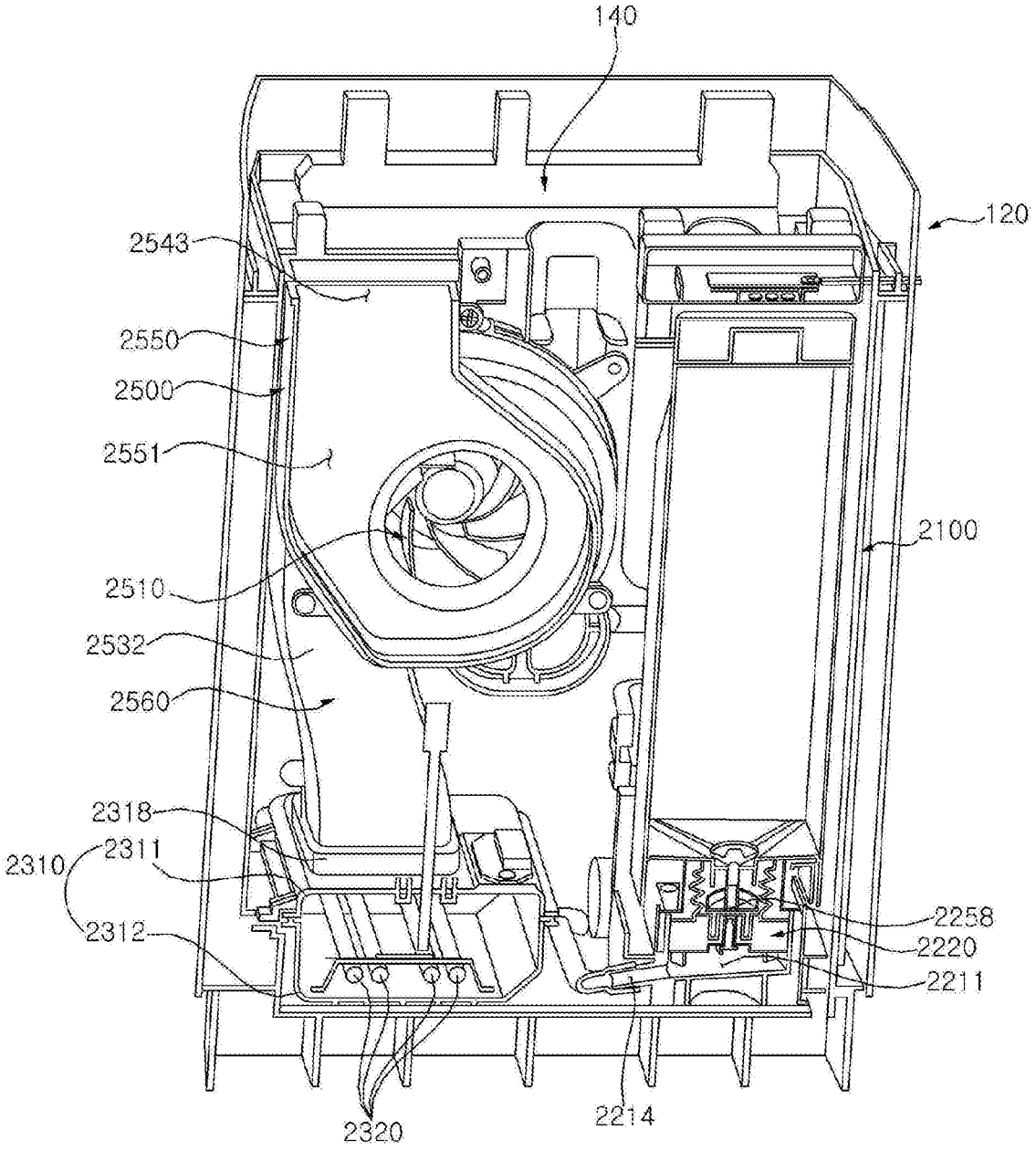
FIG. 9 is a perspective view illustrating the humidification assembly and water tank in FIG. 8.
Figure 10:
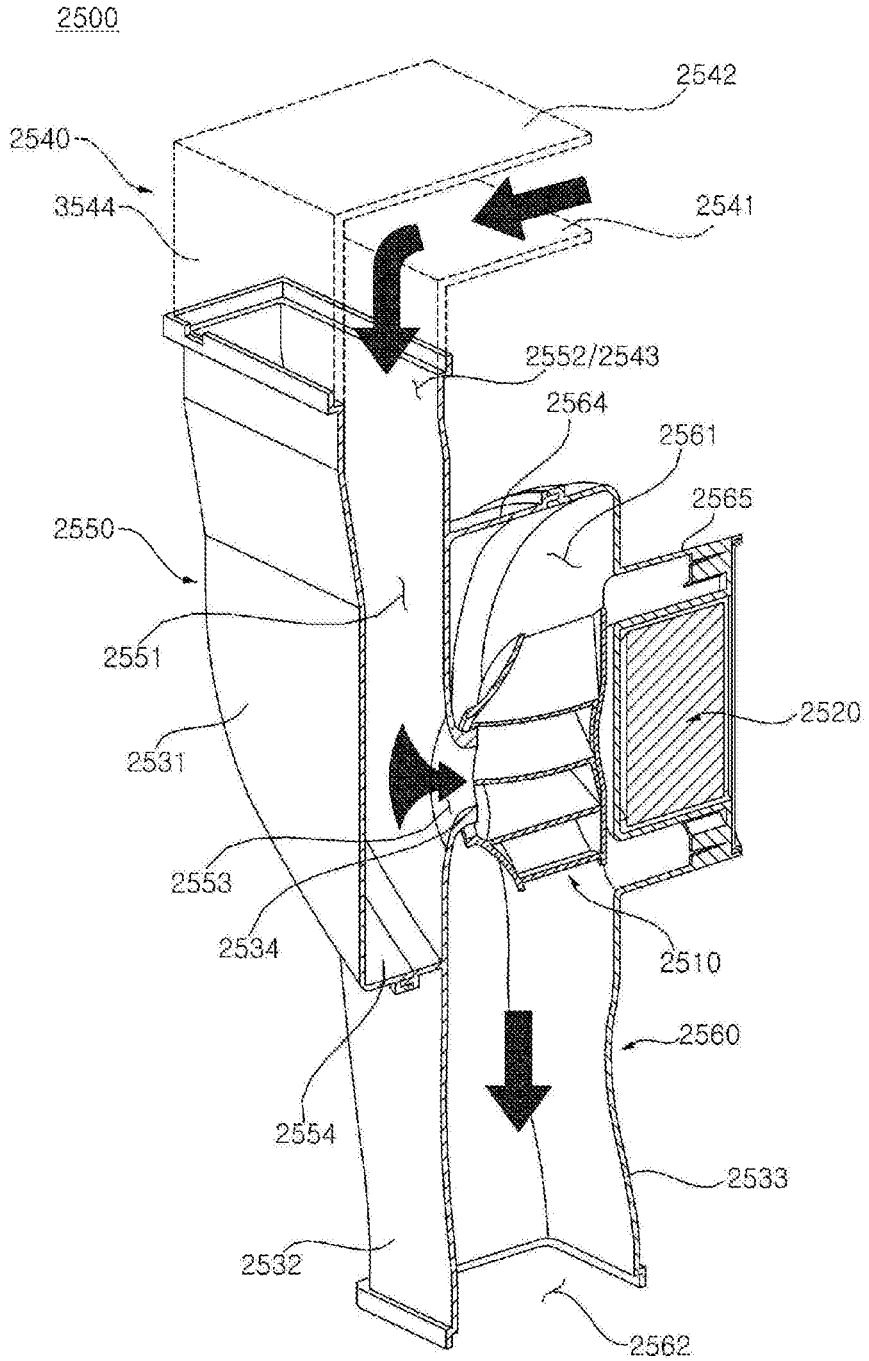
FIG. 10 is a cross-sectional view illustrating a partially cut portion of the humidification fan in FIG. 6.
Figure 11:
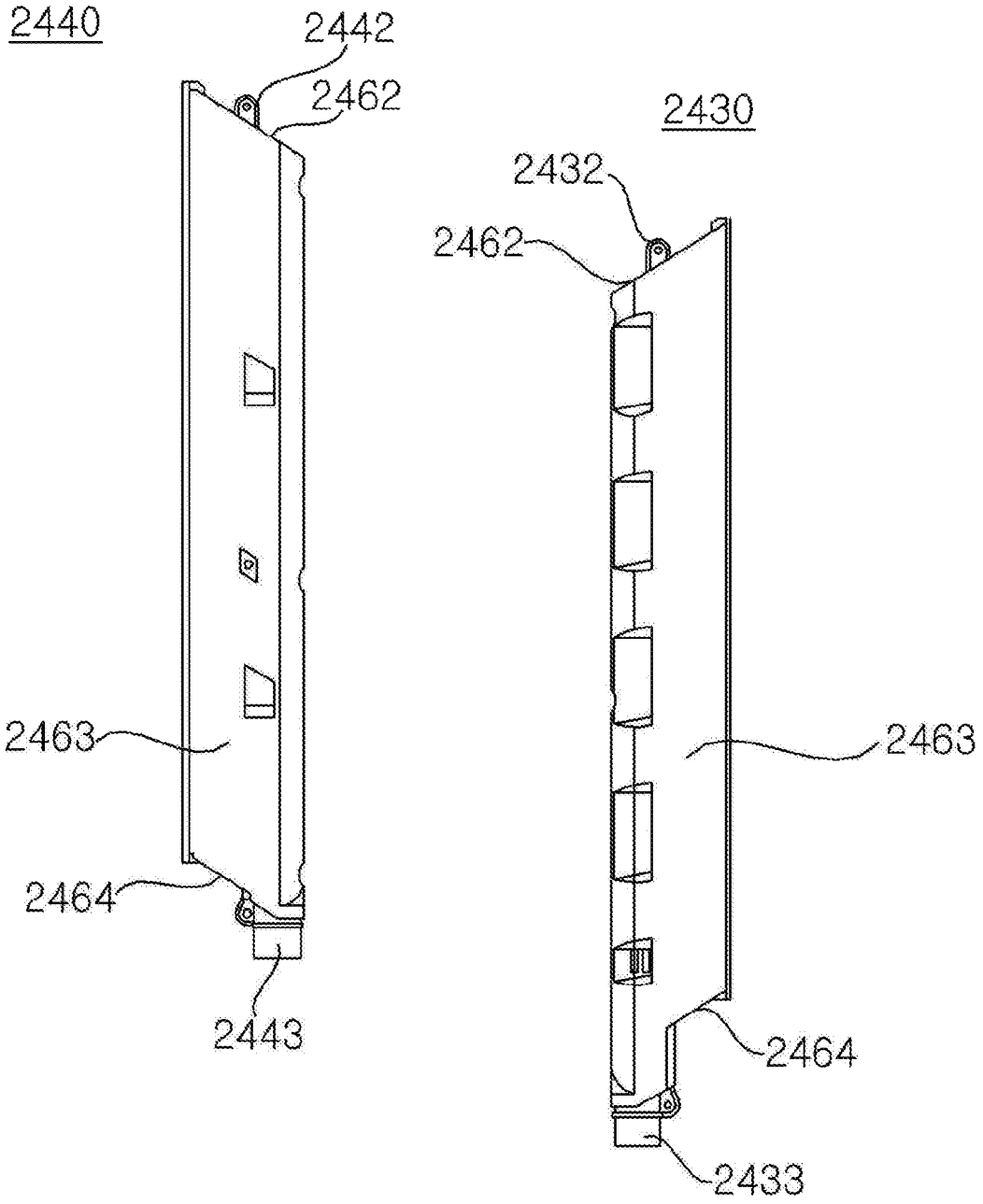
FIG. 11 is a front view illustrating the pair of diffusers in FIG. 6.
Figure 12:
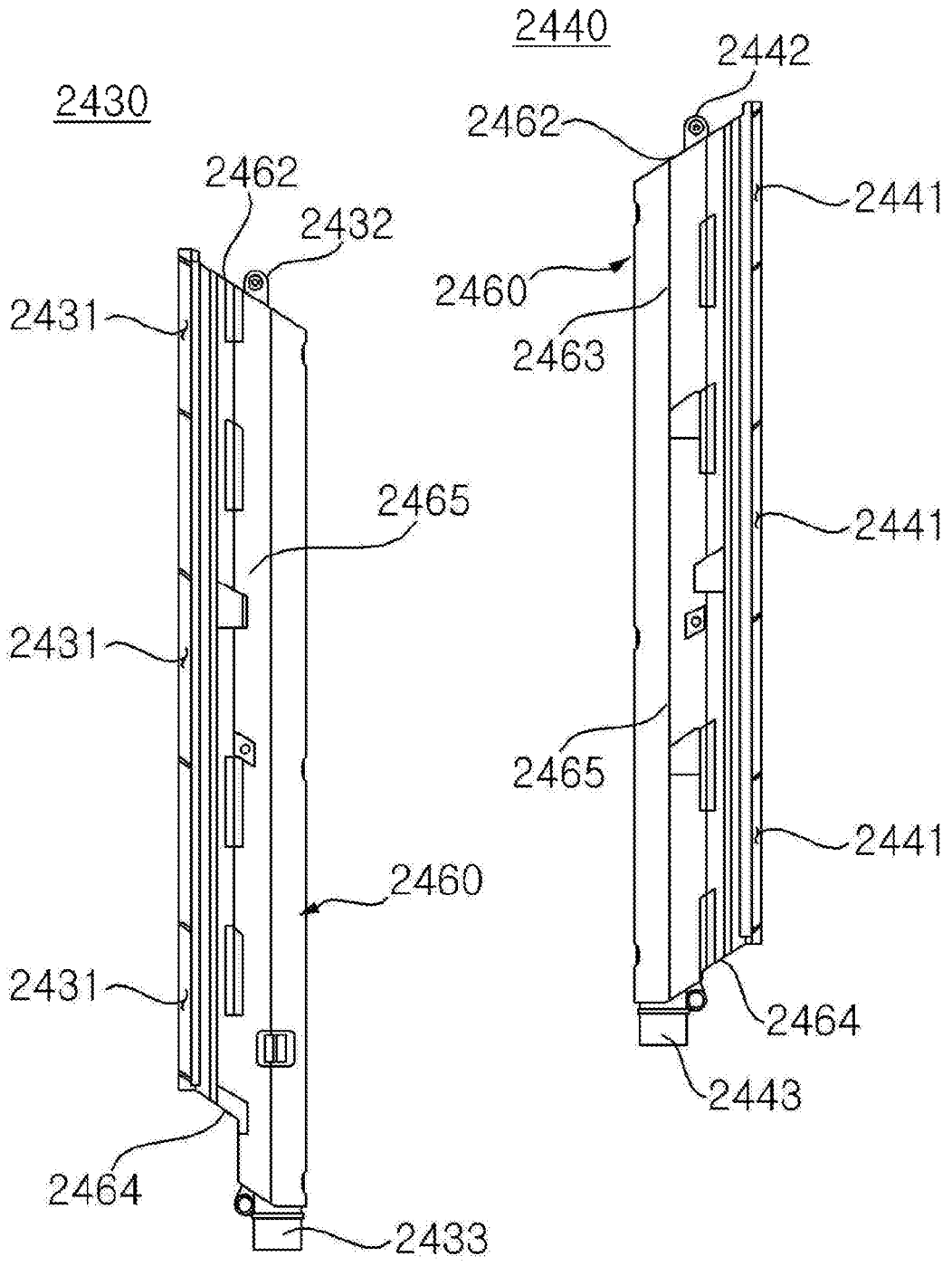
FIG. 12 is a rear view illustrating the pair of diffusers in FIG. 6.
Figure 14:
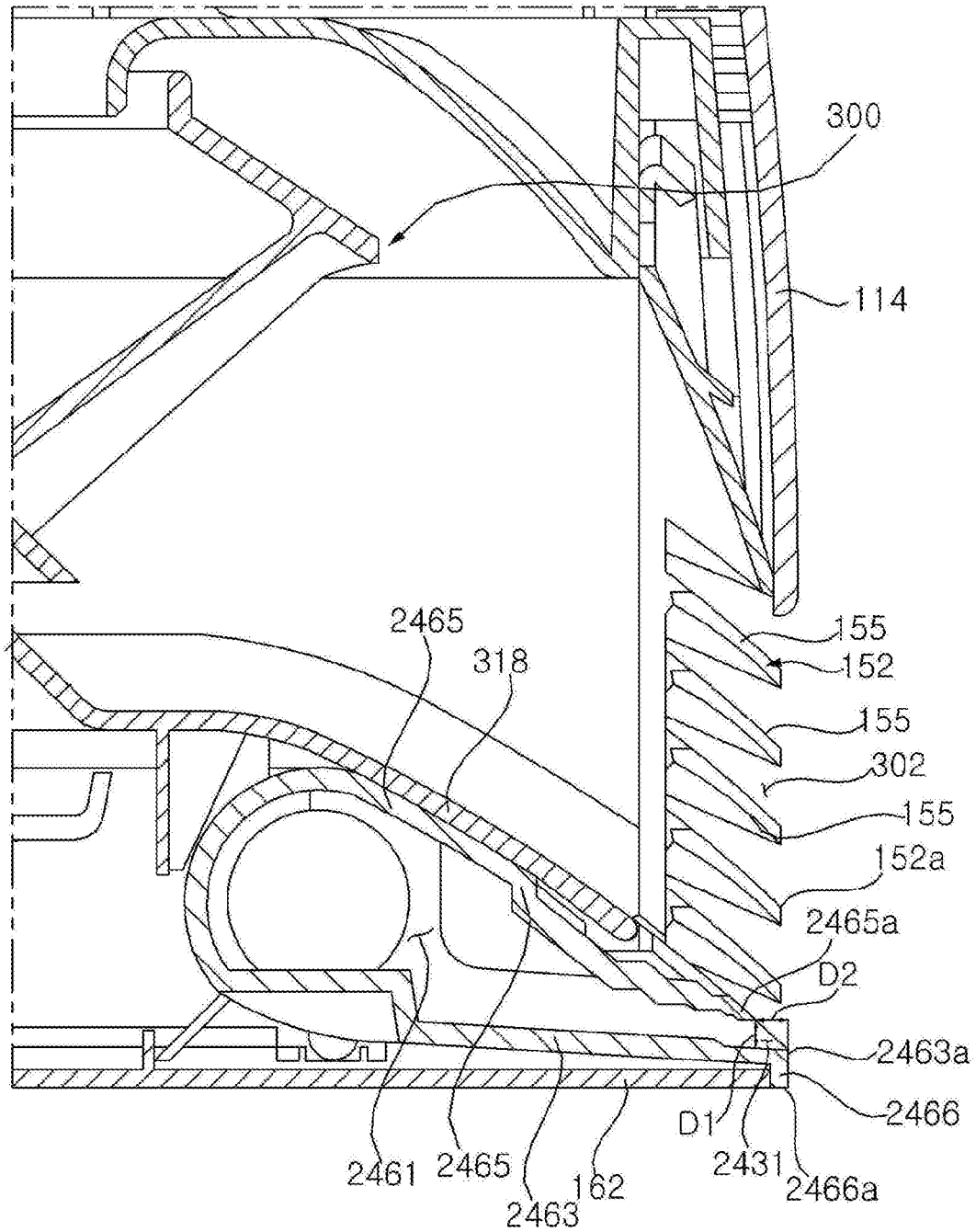
FIG. 14 is an enlarged view illustrating the diffuser in FIG. 13.
Figure 15:
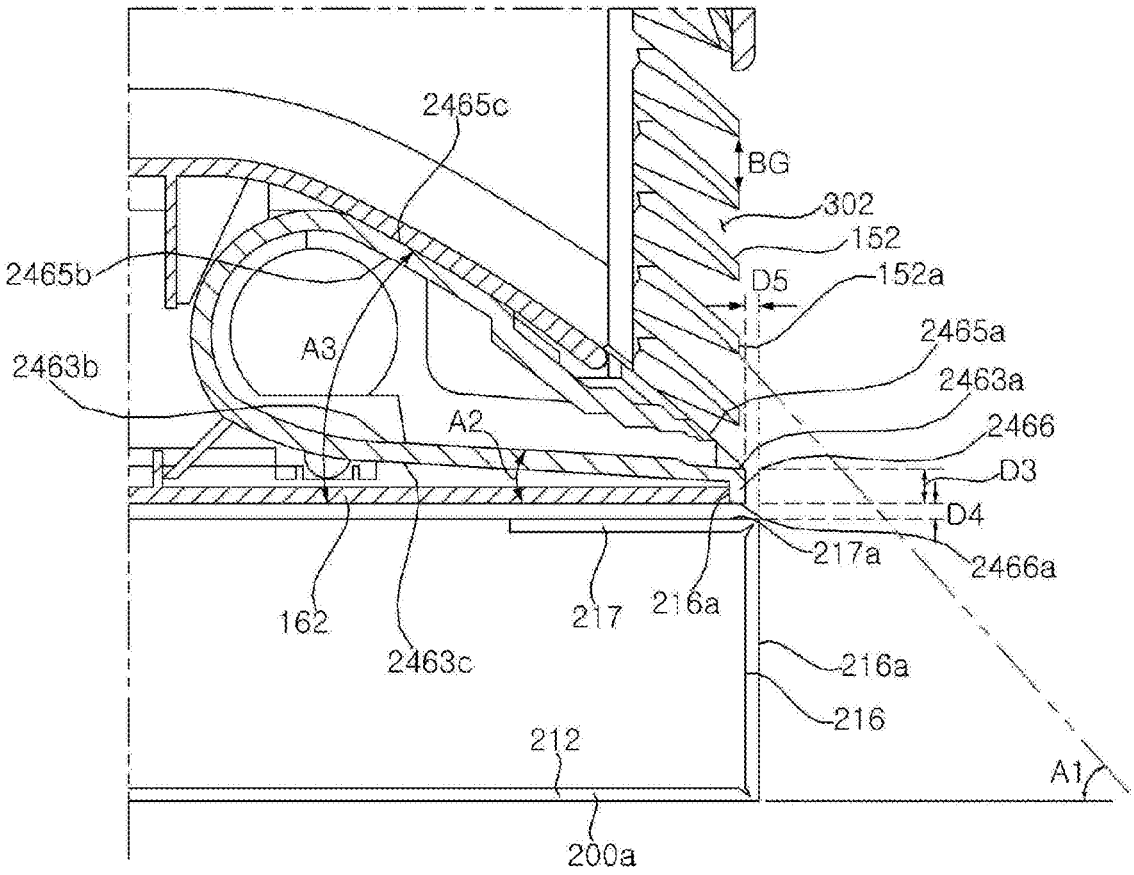
FIG. 15 is an enlarged view illustrating a peripheral structure of the diffuser outlet in FIG. 14.
Figure 16:
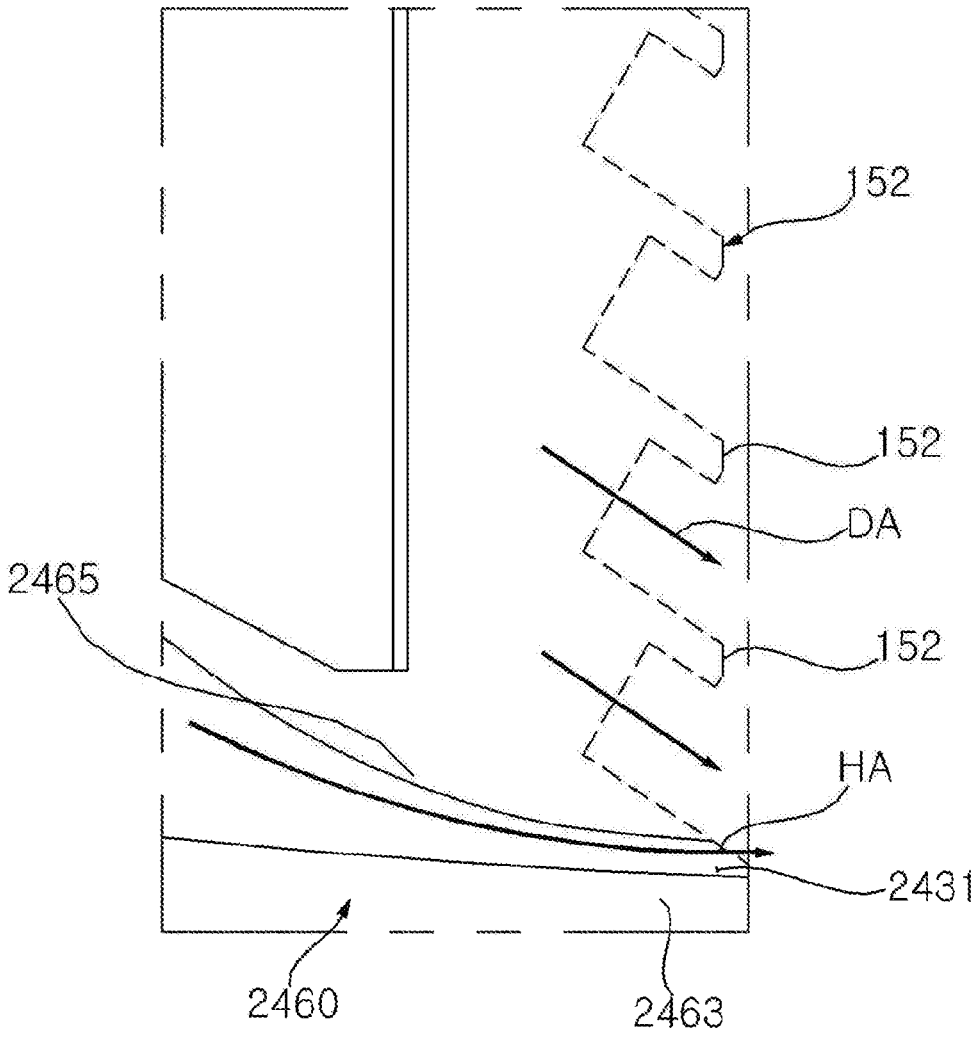
FIG. 16 is an exemplary view illustrating an air stream in a first exemplary diffuser.
Figure 17:
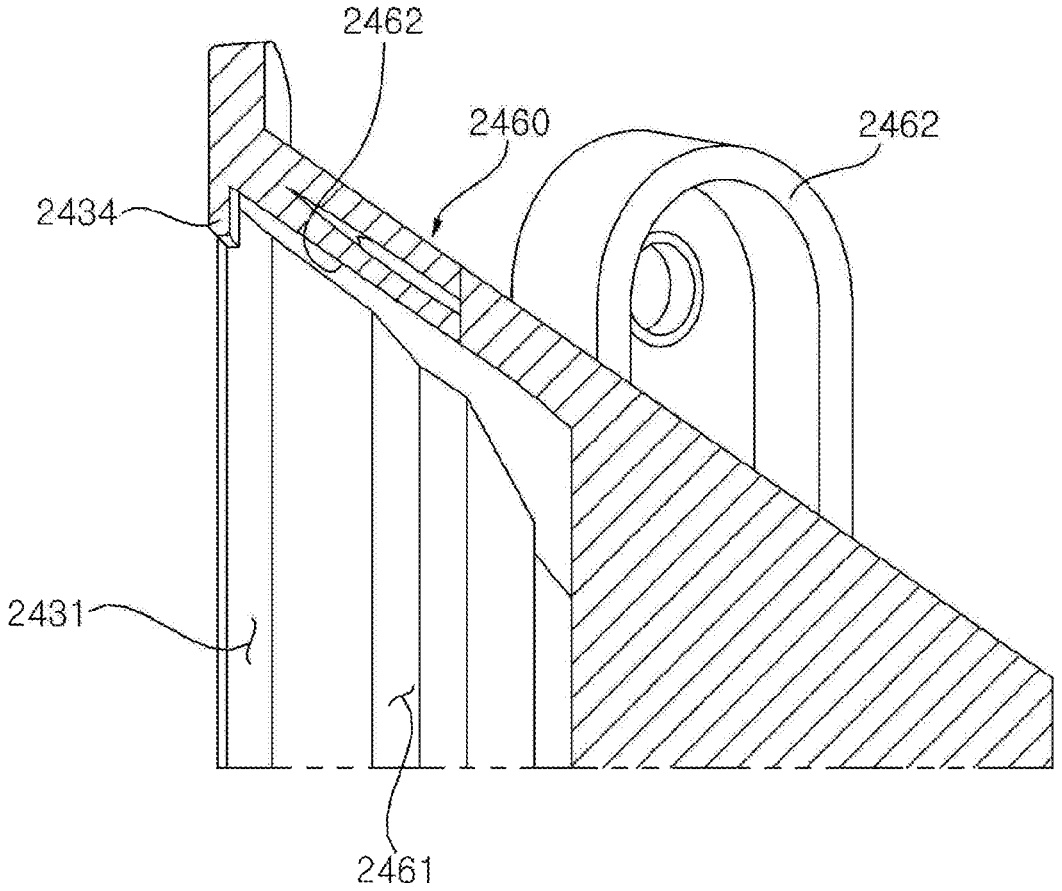
FIG. 17 is a cross-sectional view illustrating the upper side of the diffuser outlet of the diffuser housing in FIG. 11.
Figure 18:
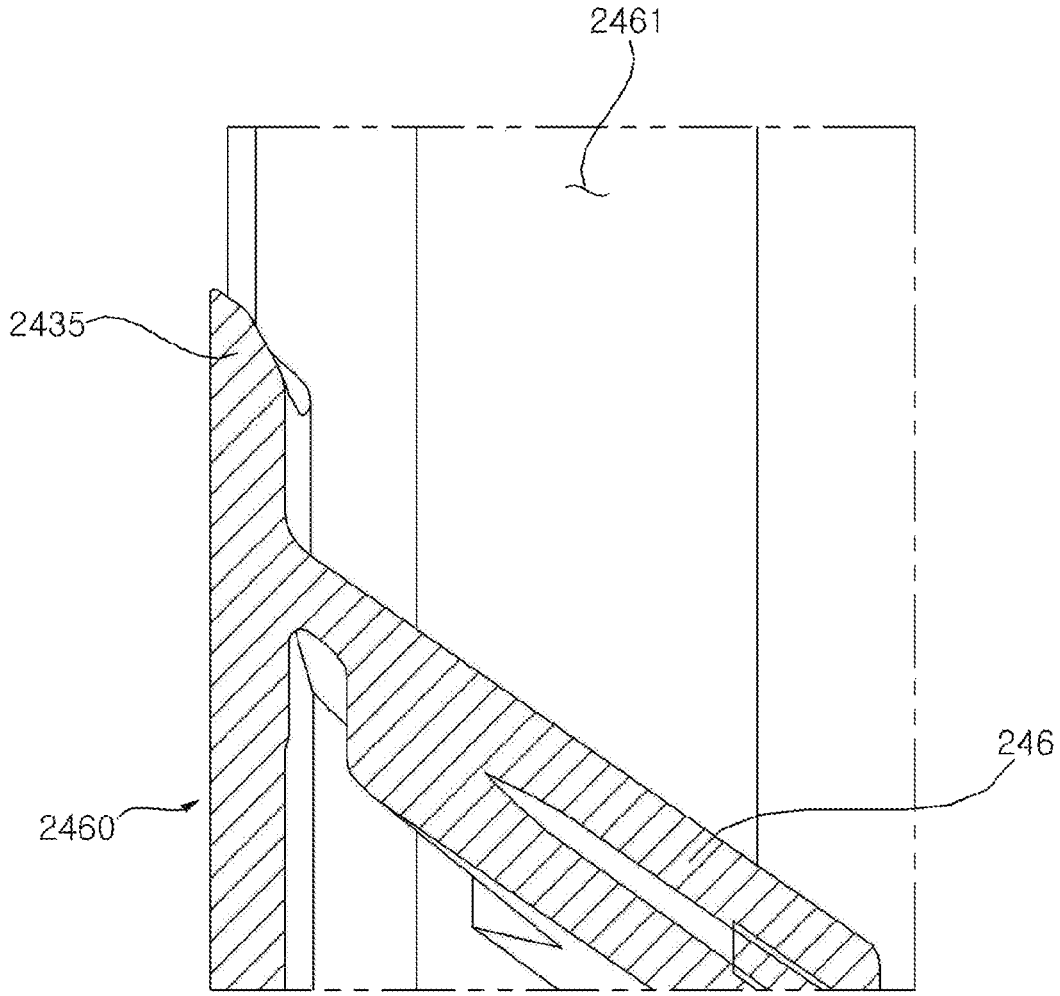
FIG. 18 is a cross-sectional view illustrating the lower side of the diffuser outlet of the diffuser housing in FIG. 11.

FIG. 5 is a perspective view illustrating the humidification assembly and the water tank in FIG. 4 assembled to a lower cabinet. FIG. 6 is a perspective view illustrating a rear of a first exemplary humidification assembly. FIG. 7 is a front view illustrating an inside of the lower cabinet in FIG. 3. FIG. 8 is a cross-sectional view illustrating the humidification assembly and the water tank in FIG. 7. FIG. 9 is a perspective view illustrating the humidification assembly and water tank in FIG. 8. FIG. 10 is a cross-sectional view illustrating a partially cut portion of the humidification fan in FIG. 6. FIG. 11 is a front view illustrating the pair of diffusers in FIG. 6. FIG. 12 is a rear view illustrating the pair of diffusers in FIG. 6. FIG. 13 is an exemplary view in which the diffuser in FIG. 6 is installed. FIG. 14 is an enlarged view illustrating the diffuser in FIG. 13. FIG. 15 is an enlarged view illustrating a peripheral structure of the diffuser outlet in FIG. 14. FIG. 16 is an exemplary view illustrating an air stream in a first exemplary diffuser. FIG. 17 is a cross-sectional view illustrating the upper side of the diffuser outlet of the diffuser housing in FIG. 11. FIG. 18 is a cross-sectional view illustrating the lower side of the diffuser outlet of the diffuser housing in FIG. 11.

Configuration of Humidification Assembly

The humidification assembly 2000 may supply moisture onto a discharge path of the fan assembly 300, 400, and the supplied moisture may be discharged to an indoor space. The humidification assembly 2000 may be optionally operated by operation signals of a controller.

In this embodiment, the moisture supplied by the humidification assembly 2000 may be directly supplied to the lateral outlet 301, 302. The moisture supplied by the humidification assembly 2000 may be in a state of being atomized or in a state of being steamed. In this embodiment, the humidification assembly 2000 transforms water in a water tank 2100 into steam and supplies the steam to the discharge path.

In this embodiment, the humidification assembly 2000 is placed at the inner lower side of the cabinet assembly 100. Specifically, the humidification assembly 2000 may be placed in the lower cabinet 120.

The humidification assembly 2000 may be placed at the base 110 and may be wrapped by the lower cabinet 120. The drain pan 140 may be placed at an upper side of the humidification assembly 2000, and steam generated by the humidification assembly 2000 directly flows to the lateral outlet 301, 302 through a steam guide 2400. That is, a space in which the humidification assembly 2000 is installed, and a space inside the upper cabinet 110 are divided.

The humidification assembly 2000 may include a water tank 2100 that may be placed at the cabinet assembly 100 and that stores water, a steam generator 2300 that may be placed at the cabinet assembly 100, that is supplied with water stored in the water tank 2100 and that transforms water stored in the steam generator 2300 into steam and generates humidified air, a humidification fan 2500 that may be placed at the cabinet assembly 100, that is coupled to the steam generator 2300 and that supplies filtered air having passed through the filter assembly 600 to the steam generator 2300, a steam guide 2400 that may be placed at the cabinet assembly 100 and that guides humidified air generated by the steam generator 2300 to the lateral outlet 301, 302 of the cabinet assembly 100 through an independent path, a water supply assembly 2200 that may be placed at the cabinet assembly 100, at which the water tank 2100 is detachably held and that supplies water in the water tank

2100 to the steam generator 2300, a tilting assembly that may be placed at the cabinet assembly 100 or the water supply assembly 2200, that optionally tilts the water tank 2100 forwards according to electric signals and that returns the forward-tilted water tank to a primary place of the water tank, and a drain assembly 2700 that may be connected to the water supply assembly 2200 and the steam generator 2300 and that drains water of the water supply assembly 2200 and the steam generator 2300 outwards.

Configuration of Steam Generator

The steam generator 2300 receives water from the water supply assembly 2200 and generates steam. The steam generator 2300 may supply sterilized steam because the steam generator 2300 heats water to generate steam.

The steam generator 2300 may include a steam housing 2310, a steam heater 2320 that may be placed in the steam housing 2310 and that generates heat by supplied power, a water supplier 2314 that may be placed at the steam housing 2310 and that is connected to a chamber housing pipe 2214 of the water supply assembly 2200 to receive water, a steam discharger 2316 that may be placed at the steam housing 2310, that is connected to the steam guide 2400 and that supplies steam generated in the steam housing 2310 to the steam guide 2400, and an air suctioner 2318 that may be placed at the steam housing 2310, that is connected to the humidification fan 2500 and that receives filtered air in the cabinet assembly 100 from the humidification fan 2500.

The steam housing 2310 has a structure that is sealed from the outside. The water supplier 2314 and the steam discharger 2316 only communicate with an inside of the steam housing 2310. The steam housing 2310 may be installed at the base 130.

The steam housing 2310 may include an upper steam housing 2311 and a lower steam housing 2312.

The upper steam housing 2311 has a shape in which an upper side is opened and which may be concavely formed downwards. The lower steam housing 2312 has a shape in which a lower side is opened and which may be concavely formed upwards.

In this embodiment, the water supplier 2314 is placed at the lower steam housing 2312, and the steam discharger 2316 is placed at the upper steam housing 2311.

The water supplier 2314 protrudes from the upper steam housing 2311 toward the water supply assembly 2200. The water supplier 2314 is connected with the chamber housing pipe 2214 and may be placed laterally. In this embodiment, the water supplier 2314 has a pipe shape with a hollow inside.

Water inside a supply chamber 2211 may be introduced into the water supplier 2314 by its self-weight. To this end, the water supplier 2314 may be placed lower than the chamber housing pipe 2214. In particular, the water supplier 2314 may be placed at a height the same as a height of an outer end 2214*b* of the chamber housing pipe 2214 or may be placed lower than the outer end 2214*b* of the chamber housing pipe 2214.

In particular, the water supplier 2314 is connected to a lowermost side of the lower steam housing 2312. In this embodiment, the water supplier 2314 is not provided with an additional valve.

With the structure in which the water supplier 2314 and the chamber housing pipe 2214 communicate with each other, a water level of the supply chamber 2211 and a water level of the steam housing 2310 may be the same.

Specifically, when a sufficient amount of water is supplied into the steam housing 2310, the water level of the supply chamber 2211 and the water level of the steam housing 2310 may be the same, and a supply floater 2220 of the water supply assembly 2200 may go up according to an increase in the water level and may close a middle hole 2258 through which water is supplied.

In this embodiment, the chamber housing pipe 2214 may be placed within a height of the steam heater 2320. The chamber housing pipe 2214 may be placed lower than a maximum water level of the steam generator 2300.

The middle hole 2258 is placed higher the maximum water level of the steam generator 2300. In this embodiment, the middle hole 2258 is spaced a distance (H) apart from an upper end of the steam heater 2320.

The steam discharger 2316 communicates with an inside of the upper steam housing 2311. The steam discharger 2316 penetrates the upper steam housing 2311 in the up-down direction. The steam discharger 2316 protrudes from an upper surface of the upper steam housing 2311 upwards for a connection with the steam guide 2400.

The air suctioner 2318 may be placed at the steam housing 2310, and, specifically, is placed at the upper steam housing 2311. The air suctioner 2318 communicates with an inside of the upper steam housing 2311, and introduces air supplied by the humidification fan 2500.

The air suctioner 2318 protrudes from the upper surface of the upper steam housing 2311 upwards for a connection with the humidification fan 2500.

In this embodiment, the air suctioner 2318 is placed at a rear of the steam discharger 2316. The air suctioner 2318 may be placed closer to the humidification fan 2500 than to the steam discharger 2316.

The air suctioner 2318 connects with the humidification fan 2500 and receives filtered air from the humidification fan 2500. The air suctioner 2318 is supplied with air having passed through the filter assembly 600 and having been filtered. The filtered air supplied to the air suctioner 2318 is introduced into the steam housing 2310, and is discharged to the steam discharger 2316 together with steam inside the steam housing 2310.

When ordinary air, not filtered air, is introduced into the steam housing 2310, fungi and the like is highly likely to breed in the steam housing 2310.

In this embodiment, because air supplied into the steam housing 2310 is limited to filtered air, contamination inside the steam housing 2310, caused due to bacteria or fungi and the like, may be minimized when the steam generator 2300 does not operate.

The steam generator 2300 according to this embodiment may maximize flow pressures of steam because an air flow of the humidification fan 2500 is supplied in the steam generator 2300 and the air flow pushes the steam out of the steam housing 2310.

Unlike the structure of this embodiment, a structure, in which the humidification fan suctions out steam outside of the steam housing, may not smoothly discharge steam inside the steam housing.

When steam generated by the steam generator 2300 does not rapidly flow to the lateral outlet 301, 302, droplets may be formed during a movement of steam.

In this embodiment, because the humidification fan 2500 supplies air to a portion of the steam generator 2300, into which air is suctioned, formation of droplets, which occurs during a flow of steam, may be minimized. Additionally, in this embodiment, because air of the humidification fan 2500 pushes steam in the steam housing 2310 out of the steam housing 2310, sufficient flow velocity of air may be ensured.

In particular, in this embodiment, because sufficient flow velocity of air that allows steam to flow is ensured, condensate may be naturally evaporated by the flow velocity of the air even though droplets are formed during a flow of the steam.

Configuration of Steam Guide

The steam guide 2400 supplies steam of the steam generator 2300 to the discharge path. The discharge path includes a path of air moved by the long-distance fan assembly 400 and a path of air moved by the short-distance fan assembly 300.

In this embodiment, the discharge path is placed at the cabinet assembly 100 and is defined as a path on which air that passes through the filter assembly 600 moves before being discharged out of the cabinet assembly 100.

In this embodiment, the steam guide 2400 guides steam generated by the steam generator 2300 to the lateral outlet 301, 302. The steam guide 2400 provides an additional path separated from the air path inside the cabinet assembly 100. The steam guide 2400 may be provided in a pipe form or a duct form.

The steam guide 2400 may include a main steam guide 2450 that is coupled to the steam generator 2300 and that receives humidified air of the steam generator 2300, a first branch guide 2410 that is coupled to the main steam guide 2450 and that guides a part of the humidified air supplied through the main steam guide 2450 to the first lateral outlet 301, a second branch guide 2420 that is coupled to the main steam guide 2450 and that guides the rest of the humidified air supplied through the main steam guide 2450 to the second lateral outlet 302, a first diffuser 2430 that is assembled to the first branch guide 2410, that is placed at the first lateral outlet 301 and that discharges the humidified air supplied through the first branch guide 2410 to the first lateral outlet 301, and a second diffuser 2440 that is assembled to the second branch guide 2420, that is placed at the second lateral outlet 302 and that discharges the humidified air supplied through the second branch guide 2420 to the second lateral outlet 302.

Unlike the first branch guide 2410 and second branch guide 2420 of this embodiment, the first branch guide 2410 and second branch guide 2420 may be directly coupled to the steam generator 2300. In this case, each steam discharger to which the first branch guide 2410 and second branch guide 2420 are coupled may be placed at the steam generator 2300.

Unlike the first branch guide 2410 and second branch guide 2420 of this embodiment, a single branch guide may only be provided and may have a structure in which the single branch guide is coupled to a single diffuser. In this case, the single diffuser may be placed only at any one of the first lateral outlet or the second lateral outlet.

In this embodiment, the diffuser may be placed at the lateral outlet. However, the diffuser may also be placed at the front outlet. That is, a position at which the diffuser may be installed is not limited only to the lateral outlet.

In this embodiment, the main steam guide 2450 may be provided in a duct form. The main steam guide 2450 guides air from a lower side to an upper side. The main steam guide 2450 supplies air (steam and air mixed with filtered air) supplied by the steam generator 2300 to the first branch guide 2410 and the second branch guide 2420.

The air (steam and air mixed with filtered air) supplied by the steam generator 2300 may be branched into the first branch guide 2410 and the second branch guide 2420 in the main steam guide 2450.

A lower end of the main steam guide 2450 may be coupled to the steam discharger 2316 of the steam housing 2310. An upper end of the main steam guide 2450 may be coupled to the first branch guide 2410 and the second branch guide 2420.

A lower side of the main steam guide 2450 may be opened. A first guide coupler 2451 to which the first branch guide 2410 is assembled may be placed at an upper side of the main steam guide 2450, and a second guide coupler 2452 to which the second branch guide 2420 is assembled may be placed at the upper side of the main steam guide 2450.

The first guide coupler 2451 and the second guide coupler 2452 are penetrated in the up-down direction. In this embodiment, the first guide coupler 2451 and the second guide coupler 2452 are provided in a pipe form.

The first branch guide 2410 may be provided in a pipe form corresponding to a flat cross section of the first guide coupler 2451. The second branch guide 2420 may be provided in a pipe form corresponding to a flat cross section of the second guide coupler 2451.

In this embodiment, when seen from the front surface of the cabinet assembly 100, the main seam guide 2450 may be disproportionately placed to one side (the left side). Accordingly, the first branch guide 2410 and the second branch guide 2420 have different lengths.

Preferably, the first branch guide 2410 and the second branch guide 2420 are supplied with air equally. In this embodiment, the first branch guide 2410 and the second branch guide 2420 are manufactured to have different pipe sizes, thereby uniformly setting flow rates of the first branch guide 2410 and the second branch guide 2420.

For example, when a short-length steam guide has a small pipe size and a long-length steam guide has a large pipe size, flow rates may be uniformly set.

The first diffuser 2430 and the second diffuser 2440 are symmetrical in the left-right direction.

The first diffuser 2430 is assembled to the first branch guide 2410, and may be placed at the first lateral outlet 301. The first diffuser 2430 discharges air, supplied through the first branch guide 2410 together with steam, to the first lateral outlet 301.

The steam generator 2300 heats water to generate steam. Accordingly, high-temperature steam may be generated. Temperatures of humidified air discharged from the first diffuser 2430 and the second diffuser 2440 may vary depending on temperatures of an indoor space but may be between 50 degrees Celsius to 70 degrees Celsius. That is, humidified air discharged from the first diffuser 2430 and the second diffuser 2440 may cause burns to users.

Accordingly, when the humidification assembly operates, the short-distance fan assembly 300 has to operate and the temperature of the humidified air has to be lowered by mixing air discharged from the side grill 151, 152 with the humidified air.

Accordingly, the humidified air discharged from the diffuser 2430, 2440 may be mixed with the air discharged from the lateral outlet 301, 302.

The first diffuser 2430 discharges air discharged from the first lateral outlet 301 by carrying filtered air including steam onto the air discharged from the first lateral outlet 301. Flow velocity and pressure of the air discharged from the first lateral outlet 301 are higher than flow velocity and pressure of the air discharged from the first diffuser 2430.

The air discharged from the first lateral outlet 301 may diffuse the steam discharged from the first diffuser 2430 farther away. The second diffuser 2440 operates according to the same theory as the first diffuser 2430.

Because flow velocity and pressure of the air discharged from the lateral outlet 301, 302 may be higher than flow velocity and pressure of the air discharged from the diffuser 2430, 2440, formation of droplets around the later outlet 301, 302, caused due to steam, may be minimized.

The second diffuser 2440 is assembled to the second branch guide 2420, and may be placed at the second lateral outlet 302. The second diffuser 2440 discharges air, supplied through the second branch guide 2420 together with steam, to the second lateral outlet 302.

The first diffuser 2430 and the second diffuser 2440 have the same structure. Accordingly, the first diffuser 2430 is described as an example.

The first diffuser 2430 discharges air, supplied from a lower side together with steam, to the lateral outlet.

The diffuser (in this embodiment, the first diffuser and the second diffuser) includes a diffuser housing 2460 that has a space therein and that has one opened side (in this embodiment, a lower side), a diffuser outlet 2431, 2441 that is formed to pass through the diffuser housing 2460, a diffuser coupler 2432, 2442 that may be placed at an outer side of the diffuser housing 2460 and that is coupling-fixed to the cabinet assembly 100, a diffuser inlet 2433, 2443 that may be placed at the diffuser housing 2460 and that is assembled to the steam guide 2420, 2430, an upper diffuser barrier 2434 that may be placed at the diffuser housing 2460, that may be placed at an upper side of the diffuser outlet 2431, 2441 and that protrudes downwards, a lower diffuser barrier 2435 that may be placed at the diffuser housing 2460, that may be placed at a lower side of the diffuser outlet 2431 and that protrudes upwards.

For convenience of description, when diffuser outlets of the first diffuser 2430 and the second diffuser 2440 are required to distinguish, the diffuser outlets are defined as a first diffuser outlet 2431 and a second diffuser outlet 2441. Likewise, when diffuser inlets of the first diffuser 2430 and the second diffuser 2440 are required to distinguish, the diffuser inlets are defined as a first diffuser inlet 2433 and a second diffuser inlet 2443.

The diffuser outlet 2431 may be provided in a slit form. The diffuser outlet 2431 extends in the up-down direction. A plurality of diffuser outlets 2431 may be placed in a lengthwise direction of the diffuser housing 2460. The diffuser outlet 2431 may be placed to face a left side or a right side.

The diffuser outlet 2431 may be placed near the lateral outlet 301, 302 of the cabinet assembly 100.

The first diffuser outlet 2431 may be placed to face a left side of the cabinet assembly 100, and the second diffuser outlet 2441 may be placed to face a right side of the cabinet assembly 100.

In this embodiment, the diffuser outlet 2431 may be placed further forward than the lateral outlet 301, 302, and may allow humidified air to flow farther away by a flow of air discharged from the lateral outlet 301, 302.

The diffuser housing 2460 includes a diffuser space 2461 therein. The diffuser space 2461 communicates with the diffuser inlet 2433 and the diffuser outlet 2431.

The diffuser space 2461 extends in the up-down direction. From a flat cross section perspective, an inner side of the diffuser space 2461 may be wide and an outer side of the diffuser space 2461 may be narrow.

The diffuser outlet 2431 may be placed at an outer side of the diffuser space 2461. The diffuser inlet 2433 may be placed at a lower side of the diffuser space 2461. In this embodiment, the diffuser inlet may be provided in a pipe form.

The diffuser inlet 2433 is inserted into the steam guide 2420. When the diffuser inlet 2433 is inserted into the steam guide 2420, condensate generated in the diffuser housing 2460 may be prevented from leaking outwards.

The condensate formed inside the diffuser housing 2460 may flow to a lower side by its self-weight, may move to the steam guide 2420 through the diffuser inlet 2433, and then may pass through the main steam guide 2450 and return to the steam generator 2300.

When the humidification fan 2500 operates, the condensate inside the diffuser housing 2460 maybe naturally evaporated by flowing air. When the humidification fan 2500 does not operate, the condensate formed inside the diffuser housing 2460 may return to the steam generator 2300 and may be discharged outwards through the drain assembly.

The diffuser housing 2460 has a structure that may guide the condensate formed inside the diffuser housing 2460 to the lower side. To this end, a diffuser upper wall 2462 and a diffuser lower wall 2464 that constitute the diffuser space 2461 form inclined surfaces.

The diffuser upper wall 2462 is an inclined surface the outer side of which is high and the inner side of which is low. The diffuser upper wall 2462 forms an upper wall of the diffuser housing 2460. The diffuser space 2461 is formed at a lower side of the diffuser upper wall 2462. The diffuser upper wall 2462 forms an incline with respect to the left-right direction. The condensate formed on the diffuser upper wall 2462 may easily move to the lower side along the incline of the diffuser upper wall 2462.

The diffuser lower wall 2464 is an inclined surface the outer side is high and the inner side is low. The diffuser lower wall 2464 forms a lower wall of the diffuser housing 2460. The diffuser space 2461 is formed at an upper side of the diffuser lower wall 2464. The diffuser lower wall 2464 forms an incline with respect to the left-right direction. The condensate formed on the diffuse lower wall 2464 may readily move to the lower side along the incline of the diffuser lower wall 2464.

Additionally, the diffuser housing 2460 has a structure that may prevent the condensate formed inside the diffuser housing 2460 from being discharged outwards.

The condensate formed at the diffuser housing 2460 may be spattered out of the diffuser 2430, 2440 by flow pressures of air supplied by the humidification fan 2500.

To prevent this from happening, the upper diffuser barrier 2434 and the lower diffuser barrier 2435 are placed at the diffuser housing 2460.

The upper diffuser barrier 2434 is placed on the diffuser upper wall 2462 and protrudes from the diffuser upper wall 2464 downwards.

The upper diffuser barrier 2434 is preferably placed at an outer side of the diffuser upper wall 2462. The upper diffuser barrier 2434 is placed at an outermost side of the diffuser upper wall 2462, protrudes from an uppermost side of the diffuser upper wall 2462 to a lowermost side of the diffuser upper wall 2462, and extends from the diffuser upper wall 2462 in the front-rear direction.

The upper diffuser barrier 2434 limits movements of condensate by blocking a part of the upper side of the diffuser outlet. Condensate, pushed and moved outwards along the diffuser upper wall 2462 by flow pressures of air, is stopped by the upper diffuser barrier 2434 and may be prevented from being discharged outwards.

The lower diffuser barrier 2435 may be placed on the diffuser lower wall 2462, and protrudes from the diffuser lower wall 2462 upwards.

The lower diffuser barrier 2435 is preferably placed at an outer side of the diffuser lower wall 2464. The lower diffuser barrier 2435 may be placed at an outermost side of the diffuser lower wall 2464, protrudes from an uppermost side of the diffuser lower wall 2464 upwards, and extends from the diffuser lower wall 2464 in the front-rear direction.

The lower diffuser barrier 2435 limits movements of condensate by blocking a part of the lower side of the diffuser outlet. Condensate, pushed and moved outwards along the diffuser lower wall 2464 by flow pressures of air, is stopped by the lower diffuser barrier 2435 and is prevented from being discharged outwards.

Additionally, the diffuser housing 2460 includes a front diffuser housing 2463 that forms a front surface of the diffuser space 2461 and that may be placed to face a front, and a rear diffuser housing 2465 that forms a rear surface of the diffuser space 2461 and that may be placed to face a rear, and the front diffuser housing 2463 includes a protrusion 2466 that protrudes from an outer end 2463*a* forwards.

The front diffuser housing 2463 and the rear diffuser housing 2465 includes the diffuser space 2461 therebetween.

An outer surface 2463*c* of the front diffuser housing 2463 may be placed to face the upper cover 162. In this embodiment, the outer surface 2463*c* of the front diffuser housing 2463 and the upper cover 162 form a contained angle A2. Unlike the outer surface 2463*c* of the front diffuser housing 2463 of this embodiment, the outer surface 2463*c* of the front diffuser housing 2463 comes into close contact with a rear surface of the upper cover 162, and, accordingly, the outer surface 2463*c* of the front diffuser housing 2463 and the upper cover 162 may form a contained angle of 0°. An inner surface 2463*b* of the front diffuser housing 2463 forms the diffuser space 2461.

The rear diffuser housing 2465 may be placed at a front of a motor cover 318. In this embodiment, an outer surface 2465*c* of the rear diffuser housing 2465 comes into close contact with a front surface of the motor cover 310. An inner surface 2465*b* of the rear diffuser housing 2465 forms the diffuser space 2461.

An outer end of the motor cover 318 extends to the side grill 151, 152. The outer end of the motor cover 318 guides discharged air to the side grill 151, 152.

The diffuser outlet 2431 may be placed between the outer end 2463*a* of the front diffuser housing 2463 and an outer end 2465*a* the rear diffuser housing 2465.

The diffuser outlet 2431 is formed by the outer end 2463*a* of the front diffuser housing 2463 and the outer end 2465*a* the rear diffuser housing 2465 that are spaced apart in the front-rear direction.

To form the diffuser outlet 2431, the outer end 2463*a* of the front diffuser housing 2463 and the outer end 2465*a* of the rear diffuser housing 2465 form a distance D1 in the front-rear direction.

In this embodiment, the outer end 2463*a* of the front diffuser housing 2463 protrudes further outwards than the outer end 2465*a* of the rear diffuser housing 2465. The outer end 2463*a* of the front diffuser housing 2463 and the outer end 2465*a* of the rear diffuser housing 2465 form a distance D2 in the left-right direction.

A length of D3 is formed from the outer end 2463*a* to an end 2466*a* at a front of the protrusion 2466.

A distance of D4 is formed from the end 2466*a* at the front of the protrusion 2466 to a rear surface 217*a* of the front panel end. The distance D4 may not be set to 0 because the door assembly 200 has a structure that slides in the left-right direction with respect to the cabinet assembly 100. In the case of D4 of 0, friction and friction noise are generated when the door assembly 200 slides. In fact, it may be difficult to form D4 of 1 mm because assembly tolerances or manufacturing tolerances of the door assembly 200 and the cabinet assembly 100 is required. Accordingly, from a technical perspective, D4 is preferably set to 2 mm or more.

A distance of D5 is formed from the outer end 2463*a* to an outer surface 216*a* of the second front panel side 216.

When the outer end 2463*a* of the front diffuser housing 2463 is placed within a left-right width of the door assembly 200, formation of droplets on a surface of the door assembly 200 may be minimized.

Preferably, the outer end 2463*a* of the front diffuser housing 2463 does not protrude outside of the door assembly 200. When the outer end 2463*a* protrudes outside of the door assembly 200, discharged air discharged from the side grill has an increased force of allowing humidified air to flow forwards. By doing so, droplets may be formed at the front panel side.

The outer end 2463*a* of the front diffuser housing 2463, and a lateral side grill 151, 152 may be placed on the same line with respect the front-rear direction or the outer end 2463*a* of the front diffuser housing 2463 may be placed further inwards than the side grill 151, 152.

Specifically, the outer end 2463*a* of the front diffuser housing 2463 may be placed laterally further outwards than an outer end 155*a* of the vane 155 placed at the side grill 151, 152. The front panel side may be placed laterally further outwards than the outer end 2463*a* of the front diffuser housing 2463.

The outer end 2465*a* of the rear diffuser housing 2465 may be placed laterally further inwards than the outer end 155*a* of the vane 155 or the outer end 2463*a* of the front diffuser housing 2463. In this embodiment, the outer end 2465*a* of the rear diffuser housing 2465 is placed within a left-right length of the vane 155.

The plurality of vanes 155 form a vane gap (BG). A vane that is placed at a front most side among the plurality of vanes 155 is defined as a first vane 156.

The outer end 2465*a* of the rear diffuser housing 2465 may be placed between an outer end 156*a* of the first vane 156 and the outer end 2463*a* of the front diffuser housing 2463.

In this embodiment, a gap between the outer end 156*a* of the first vane 156 and the outer end 2463*a* of the front diffuser housing 2463 is the same as the vane gap (BG).

The diffuser outlet 2431, 2441 may be placed between the outer end 156*a* of the first vane 156 and the outer end 2463*a* of the front diffuser housing 2463.

The outer end 2465*a* of the rear diffuser housing 2465 may be placed further forwards than the outer end 156*a* of the first vane 156, and the outer end 2463*a* of the front diffuser housing 2463 may be placed further forwards than the outer end 2465*a* of the rear diffuser housing 2465.

The protrusion 2466 may be placed to wrap an outer edge 162*a* of the upper cover 162. That is, when seen from the front surface, the upper cover 162 may be placed between a protrusion (not illustrated) of the first diffuser 2430 and a protrusion 2466 of the second diffuser 2440.

The outer end 2463*a* of the front diffuser housing 2463 may be placed within the left-right width of the door assembly 200. That is, the outer end 2463*a* of the front diffuser housing 2463 does not protrude outside of a left edge of the door assembly 200 or a right edge 216*a* of the door assembly 200. The above-described D5 is preferably set to 1 mm or more.

In the case of D5, a direction from the left edge or the right edge 216*a* to an inside of the front panel 210 is defined as a (+) length, and a direction from the left edge or the right edge 216*a* to the outside of the front panel 210 is defined as a (−) length.

When the outer end 2463*a* of the front diffuser housing 2463 is placed on the same line as the left edge or the right edge 216*a* of the front panel 210 (D5=0), droplets may be formed at a surface of the left edge or the right edge 216*a*.

When a value of D5 is 1 mm or greater, formation of droplets may be efficiently reduced. When a value of D5 becomes greater, a distance between the outer end 2463*a* of the front diffuser housing 2463 and the left edge or the right edge 216*a* of the front panel 210 becomes longer.

A total length of the above-described D3 and D4 is an important factor for minimizing formation of droplets on surfaces of the first front panel side 214 and the second front panel side 216 of the front panel 210.

In this embodiment, the total length (DL) of the above-described D3 and D4 is 5 mm or greater.

For example, when D3 is 3 mm, D4 has to be 2 mm or more, and, when D4 is 2 mm, D3 has to be 3 mm or more.

When the total length (DL) is 5 mm or more, formation of droplets may be suppressed.

Because a length of the front of the side grill 151, 152 becomes longer when the total length (DL) becomes longer, in this embodiment, the total length (DL) is preferably between 5 and 10 mm, inclusive.

In this embodiment, considering design tolerances and manufacturing tolerance, the above-described D3 is set from 6 mm to 7 mm, and, considering assembly tolerances, the above-described D4 is set from 2 mm to 3 mm, and the total length (DL) is set from 8 mm to 10 mm.

The front diffuser housing 2463 comes into close contact with the upper cover 162 that covers the front surface of the upper cabinet 110. The front diffuser housing 2463 is placed at a rear of the upper cover 162 and comes into close contact with a rear surface of the upper cover 162.

The outer end 2463*a* of the front diffuser housing 2463 is formed to wrap an edge 162*a* of a lateral surface of the upper cover 162. Because the outer end 2463*a* of the front diffuser housing 2463 wraps a lateral portion of the upper cover 162, a lateral surface of the upper cover 162 is prevented from being exposed outwards.

The protrusion 2466 of the front diffuser housing 2463 forms a step together with the front diffuser housing 2463 and protrudes forwards.

Accordingly, the protrusion 2466 of the front diffuser housing 2463 is exposed outwards. In this embodiment, the protrusion 2466 of the front diffuser housing 2463 is defined as a diffuser housing decorator.

The diffuser housing decorator may be placed at an edge of a rear surface of the door assembly 200, and does not protrude further laterally than an edge of a lateral surface of the door assembly 200.

Because the diffuser housing decorator may be placed to protrude further laterally than the outer end 2465*a* of the rear diffuser housing 2465, linearity of humidified air discharged from the diffuser 2430 may be improved.

The outer end 2465*a* of the rear diffuser housing 2465 may be placed further inwards than the lateral side grill 151, 152. With respect to the front-rear direction, the outer end 2465*a* of the rear diffuser housing 2465 may be placed between the lateral side grill 151, 152 and the front diffuser housing 2463.

The rear diffuser housing 2465 is placed in an inclination direction of the lateral side grill 151, 152, and minimizes resistance against air discharged through the lateral outlet 301, 302.

The front diffuser housing 2463 is preferably placed in the left-right direction. When the front diffuser housing 2463 is placed in the left-right direction, linearity facing a lateral direction of air including steam may be improved.

The upper cover 162 and the front panel body 212 are placed in parallel.

From a flat cross section perspective, with respect to a front surface 200*a* of the front panel body 212, an angle between the front surface 200*a* and the vane 155 of the side grill 151, 152 is defined as A1. The contained angle A1 may be placed to face the front and may be formed between 40° and 50°. In this embodiment, the contained angle A1 is formed at 45°.

From a flat cross section perspective, with respect to the front surface 200*a* of the front panel body 212, an angle between the front surface 200*a* and the front diffuser housing 2463 is defined as A2.

The contained angle A2 may be formed from 0° or more to 40° or less.

As a difference between the contained angle A1 and the contained angle A2 becomes greater, formation of droplets on a surface of the front panel side may be suppressed. Accordingly, the contained angle A2 is preferably 0°, and, in this embodiment, the contained angle A2 is set to 5°.

From a flat cross section perspective, with respect to the front surface 200*a* of the front panel body 212, an angle between the front surface 200*a* and the rear diffuser housing 2465 is defined as A3.

Preferably, the contained angle A3 is smaller than an angle of the vane 155.

Considering the contained angle A2, the contained angle A3 is formed to be greater than A2 and smaller than A1.

When the contained angle A3 is greater than a tilt angle (A1) of the vane 155, resistance occurs to air facing the side grill.

A contained angle B1 is formed between the direction (Sh) faced by the outer circumferential end of the shroud 314, and the front surface 200*a* of the front panel body 212.

A contained angle B2 is formed between the direction (A) faced by the outer circumferential end of the hub 312, and the front surface 200*a* of the front panel body 212.

The contained angle B1 of the shroud 314 is preferably the same as the contained angle A1 of the vane 155. The contained angle B2 of the hub 312 is preferably the same as the contained angle A1 of the vane 155.

When the direction (Sh) of the shroud 314, the direction (A) of the hub 312, and the direction (A1) of the vane 155 are the same or similar, flow resistance of air may be minimized.

In this embodiment, the direction (A) of the hub 312 and the direction (A1) of the vane 155 are the same, and the direction (Sh) of the shroud 314 is formed more gently than the contained angle A1.

In this embodiment, the plurality of vanes 155 of the side grill are all placed between the direction (Sh) faced by the outer circumferential end of the shroud 314 and the direction (A) faced by the outer circumferential end of the hub 312.

That is, the vanes 155 are placed further rearwards than the direction (Sh) faced by the outer circumferential end of the shroud 314 and are placed further forwards than the direction (A) faced by the outer circumferential end of the hub 312.

The diffuser outlet 2431, 2441 may be placed further rearwards than the direction (A) faced by the outer circumferential end of the hub 312. The protrusion 2466 may be placed further rearwards than the direction (A) faced by the outer circumferential end of the hub 312.

Accordingly, from a flat cross section perspective, the inner side of the diffuser space 2461 inside the diffuser housing 2460 is wide and the outer side is narrow. From a flat cross section perspective, the diffuser space 2461 may be formed into a wedge shape the outer side may be sharp.

The diffuser outlet 2431 may be placed at the sharp portion of the diffuser space 2461. The diffuser outlet 2431 may be placed further forwards than the lateral outlet 301, 302. The diffuser outlet 2431 may be placed further rearwards than the door assembly 200 and may be placed further forwards than the side grill 151, 152.

The lateral outlet 301, 302 discharges air toward a front right side and a front left side, and humidified air may be discharged to the front of the lateral outlet 301, 302. When humidified air is discharged to the front of the lateral outlet 301, 302, the humidified air may flow farther away.

In the humidification assembly 2000 according to this embodiment provides humidification, a distance moved by moisture does not rely only on output of the humidification fan 2500. When a distance moved by moisture relies only on output of the humidification fan 2500, capacity of the humidification fan 2500 has to be increased or the humidification fan 2500 has to be operated at high speed.

In this embodiment, when the humidification assembly 2000 operates, moisture may be carried on an air flow of the short-distance fan assembly 300 to flow farther away. In this case, even with a low output capacity of a humidification fan 2500, the indoor unit for the air conditioner may provide humidification to a far corner of indoor space.

When the diffuser outlet 2431 is placed at the front of the lateral outlet 301, 302 rather than the rear of the lateral outlet 301, 302, humidified air may flow farther away.

A stream (HA) of humidified air discharged from the diffuser outlet 2431, and a stream (DA) of discharged air discharged from the vane 155 may be crossed. In order for the stream (HA) of humidified air and the stream (DA) of discharged air to be crossed, the inclination direction of the front diffuser housing 2463 and the inclination direction of the vane 155 are crossed.

Configuration of Humidification Fan

The humidification fan 2500 suctions filtered air having passed through the filter assembly 600 and supplies the filtered air to the steam generator 2300, and allows the filtered air together with steam generated by the steam generator 2300 to flow to the steam guide 2400.

The humidification fan 2500 generates an air flow that discharges the steam and filtered air (in this embodiment, referred to as humidified air) from the diffuser 2430, 2440.

The humidification fan 2500 includes a humidification fan housing 2530 that suctions filtered air having passed through the filter assembly 600 and that guide the filtered air suctioned to the steam generator 2300, a clean suction duct 2540 that has a lower side connected to the humidification fan housing 2530 and an upper side placed at a front of the filter assembly 600 and that supplies the filtered air having passed through the filter assembly 600 to the humidification fan housing 2530, a humidification impeller 2510 that may be placed inside the humidification fan housing 2530 and that allows filtered air of the humidification fan housing 2530 to flow to the steam generator 2300, and a humidification motor 250 that may be placed at the humidification fan housing 2530 and that rotates the humidification impeller 2510.

The clean suction duct 2540 supplies filtered air having passed through the filter assembly 600 to the humidification fan housing 2530.

Because the filter assembly 600 may be placed at the upper cabinet 110 and the humidification fan 2500 may be placed at the lower cabinet 120, there may be a difference between a height of the filter assembly 600 and a height of the humidification fan 2500. That is, the filter assembly 600 may be placed at an upper portion of the humidification fan 2500.

In particular, filtered air having passed through the filter assembly 600 flows to the short-distance fan assembly 300 and does not flow to the lower cabinet 120 or only slightly flows to the lower cabinet 120. Specifically, the lower cabinet 120 has no portion from which air may be discharged. Accordingly, unless air is artificially supplied, the filtered air does not flow or circulate into the lower cabinet 120.

Additionally, because the drain pan 140 that supports the heat exchange assembly and collects condensate is placed at a lower side of the upper cabinet 110, a flow of filtered air inside the upper cabinet 110 to the lower cabinet 120 may be significantly limited.

An upper end of the clean suction duct 2540 may be placed inside the upper cabinet 110 and a lower end of the clean suction duct 2540 may be placed inside the lower cabinet 120. That is, the clean suction duct 2540 supplies a path for allowing filtered air in the upper cabinet 110 to flow into the lower cabinet 120.

The clean suction duct 2540 includes a first clean duct 2542 that may be placed in the upper cabinet 110 and suctions filtered air, and a second clean duct 2544 that may be placed in the lower cabinet 120 and may be coupled to the humidification fan housing 2530.

The first clean duct 2542 and the second clean duct 2544 are integrally manufactured.

The first clean duct 2542 may be placed to face the heat exchange assembly, and the second clean duct 2544 may be placed to face the humidification fan housing 2530.

In this embodiment, the first clean duct 2542 is placed horizontally, and the second clean duct 2544 is placed perpendicularly.

The first clean duct 2542 may be placed at a front of the heat exchange assembly and may be placed to face the filter assembly 600. In this embodiment, the first clean duct 2542 may closely contact a front surface of the heat exchange assembly. The first clean duct 2542 may be placed at a lower front of the heat exchange assembly. The first clean duct 2542 includes a first clean duct opened surface 2541 that is opened toward the heat exchange assembly or the filter assembly 600.

The second clean duct 2544 guides filtered air supplied through the first clean duct 2542 to the humidification fan housing 2530. A lower end of the second clean duct 2544 is assembled to the humidification fan housing 2530.

The second clean duct 2544 may be placed in the up-down direction, and may be placed to cross the drain pan 140 in the up-down direction. In this embodiment, the second clean duct 2544 may be placed at a front of the drain pan 140.

The second clean duct 2544 includes a second clean duct opened surface 2543 that communicates with a first suction opened surface 2522 of a below-described first humidification fan housing 2550.

The humidification fan housing 2530 includes a first humidification fan housing 2550 that is coupled to the clean suction duct 2540, that suctions filtered air and that includes a first suction space 2551 therein, a second humidification fan housing 2560 that is coupled to the first humidification fan housing 2550 to receive filtered air from the first humidification fan housing 2550, that includes a second suction space 2561 therein, that includes the humidification impeller 2510 therein and that guides the filtered air to the steam generator 2300 through operations of the humidification impeller 2510, a first suction opened surface 2552 that is formed at the first humidification fan housing 2550, that communicates with the first suction space 2551 and that is opened toward one side (in this embodiment, the upper side), a second suction opened surface 2562 that is formed at the second humidification fan housing 2560, that communicates with the second suction space 2561 and that is opened toward the other side (in this embodiment, the lower side), a first suction space discharger 2553 that penetrates the first humidification fan housing 2550 and the second humidification fan housing 2560 and that allows the first suction space 2551 and the second suction space 2561 to communicate with each other, and a motor installator 2565 that may be placed at the second humidification fan housing 2560 and at which the humidification motor 2520 is installed.

For the first humidification fan housing 2550, a first suction opened surface 2552 is formed toward the upper side. The clean suction duct 2540 is connected to the suction opened surface 2552. For the second humidification fan housing 2560, a second suction opened surface 2562 is formed toward the lower side.

In this embodiment, a direction in which the first suction opened surface 2552 is opened is opposite to a direction in which the second suction opened surface 2562 is opened.

A lower surface 2554 of the first humidification fan housing 2550 has a round shape and may be placed further downwards than the first suction space discharger 2553. An upper surface 2564 of the second humidification fan housing 2560 has a round shape and may be placed further upwards than the first suction space discharger 2553.

A motor shaft (not illustrated) of the humidification motor 2520 penetrates the second humidification fan housing 2560 and may be assembled to the humidification impeller 2510.

The motor installator 2565 protrudes rearwards from the second humidification fan housing 2560, and the humidification motor 2520 may be inserted and installed into the motor installator 2565.

The first humidification fan housing 2550 including the first suction space 2551 and the second humidification fan housing 2560 including the second suction space 2561 may be individually manufactured and then may be assembled.

In this embodiment, to simplify an assembly structure and to reduce manufacturing costs, three parts are assembled to manufacture the humidification fan housing 2530.

The humidification fan housing 2530 includes a first humidification fan housing 2531 that is formed to wrap a front of the first suction space 2551 and that constitutes a part of the first humidification fan housing 2550, a second humidification fan housing 2532 that is formed to wrap a rear of the first suction space 2551 that is formed to wrap a front of the second suction space 2561, that includes the first suction space discharger 2553 and that constitutes the rest of the first humidification fan housing 2550 and a part of the second humidification fan housing 2560, and a third housing 2533 that is formed to wrap a rear of the second suction space 2561, that includes the motor installator 2565 and that constitutes the rest of the second humidification fan housing 2560.

The second humidification fan housing 2532 may be shared by the first humidification fan housing 2550 and the second humidification fan housing 2560, thereby reducing the number of parts and components and manufacturing costs.

The first suction space discharger 2553 may be formed at the second humidification fan housing 2532. The first suction space discharger 2553 may be formed to penetrate the second humidification fan housing 2532 in the front-rear direction.

The first suction space discharger 2553 protrudes toward the humidification impeller 2510 and has a circular shape.

The second humidification fan housing 2532 includes the first suction space discharger 2553 and an orifice 2534 that protrudes toward the humidification impeller 2510.

The second humidification fan housing 2532 includes the first suction space 2551 at a front thereof, and the second suction space 2561 at a rear thereof.

The humidification impeller 2510 may be a centrifugal fan that suctions air from a central side and discharges air circumferentially. Air discharged from the humidification impeller 2510 flows to the steam generator 2300 through the second humidification fan housing 2560.

A flow of filtered air according to driving of the humidification motor 2520 is described as follows.

When the humidification motor 2520 operates, the humidification impeller 2510 coupled to the humidification motor 2520 is rotated. When the humidification impeller 2510 rotates, an air flow occurs in the humidification fan housing 2530, and filtered air is suctioned through the clean suction duct 2540.

The filtered air suctioned through the clean suction duct 2540 passes through the first suction space 2551 of the first humidification fan housing 2550 and the first suction space discharger 2553 and flows to the second humidification fan housing 2560. The air having flowed to the second humidification fan housing 2560 is pressurized by the humidification impeller 2510, flows to the lower side along the second humidification fan housing 2560 and then flows into the steam generator 2300 through the second suction opened surface 2562.

The filtered air having flowed into the steam housing 2310 through the air suctioner 2318 of the steam generator 2300 is discharged together with steam generated by the steam generator 2300 to the steam discharger 2316.

The humidified air discharged from the steam discharger 2316 may be branched into the first branch guide 2410 and the second branch guide 2420 in the main steam guide 2450.

The humidified air having flowed to the first branch guide 2410 may be discharged to the first lateral outlet 301 through the first diffuser 2440, and the humidified air having flowed to the second branch guide 2420 may be discharged to the second lateral outlet 302 through the second diffuser 2450.

The humidified air discharged from the first lateral outlet 301 may be diffused to the left side of the cabinet assembly 100 together with wind generated through the short-distance fan assembly 300, and the humidified air discharged from the second lateral outlet 302 may be diffused to the right side of the cabinet assembly 100 together with wind generated through the short-distance fan assembly 300.

Figure 19:
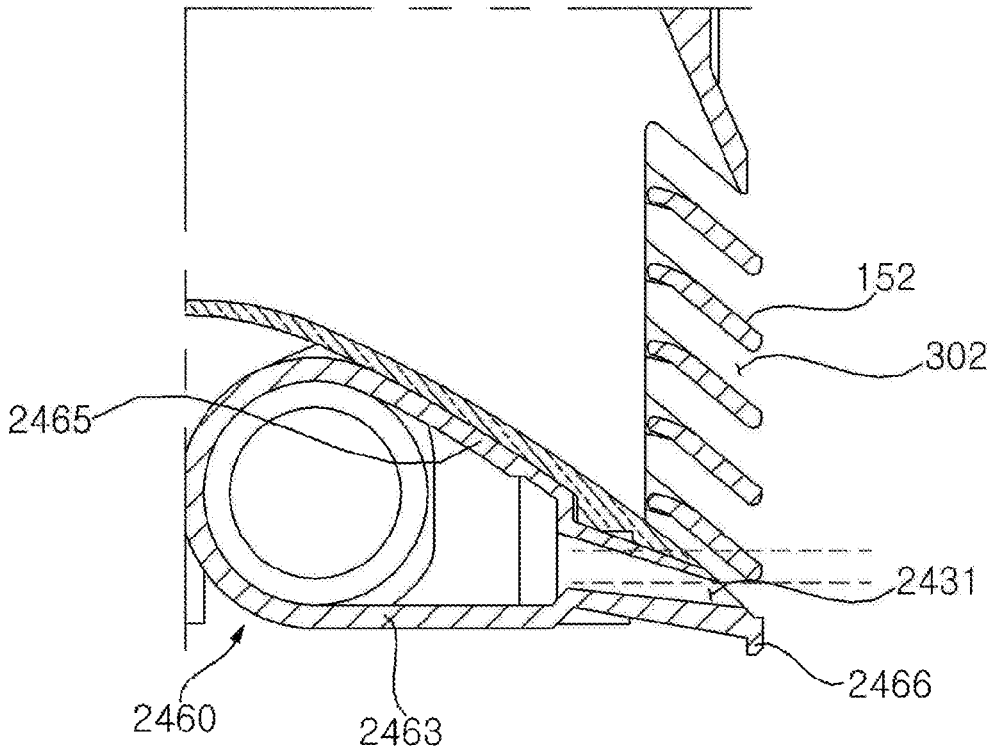
FIG. 19 is a cross-sectional view illustrating a second exemplary diffuser.

FIG. 19 is a cross-sectional view illustrating a second exemplary diffuser.

Droplets formed by the diffuser outlet 2431 are caused by a direction of air currents. To minimize the formation of droplets, preferably, a contained angle is formed to a maximum level in a direction perpendicular to the direction of air currents, and a surface contacted by air currents may be minimized.

Unlike the first exemplary diffuser, the second exemplary diffuser may suppress formation of droplets at the front panel side through the diffuser outlet 2431 moved further forwards by a predetermine distance.

The diffuser outlet 2431 of this embodiment is moved further toward the door assembly 200 by 2 mm than the first exemplary diffuser outlet.

The rest of the configurations of the second exemplary diffuser are the same as the configurations of the first exemplary diffuser. Therefore, detailed description in relation to the rest of the configurations is omitted.

Figure 20:
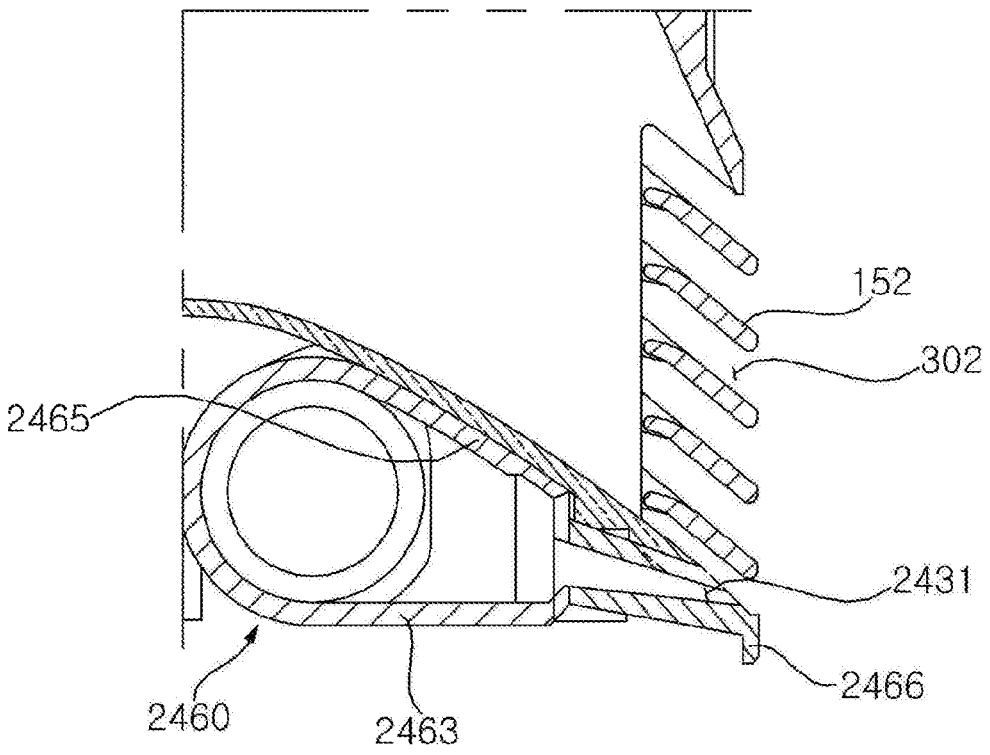
FIG. 20 is a cross-sectional view illustrating a third exemplary diffuser.

FIG. 20 is a cross-sectional view illustrating a third exemplary diffuser.

Unlike the first exemplary diffuser, the third exemplary diffuser may minimize formation of droplets at the front panel side through an increased length of the protrusion 2466. As the length of the protrusion 2466 becomes longer, formation of droplets may be suppressed.

The rest of the configurations of the third exemplary diffuser are the same as the configurations of the first exemplary diffuser. Therefore, detailed description in relation to the rest of the configurations is omitted.

Figure 21:
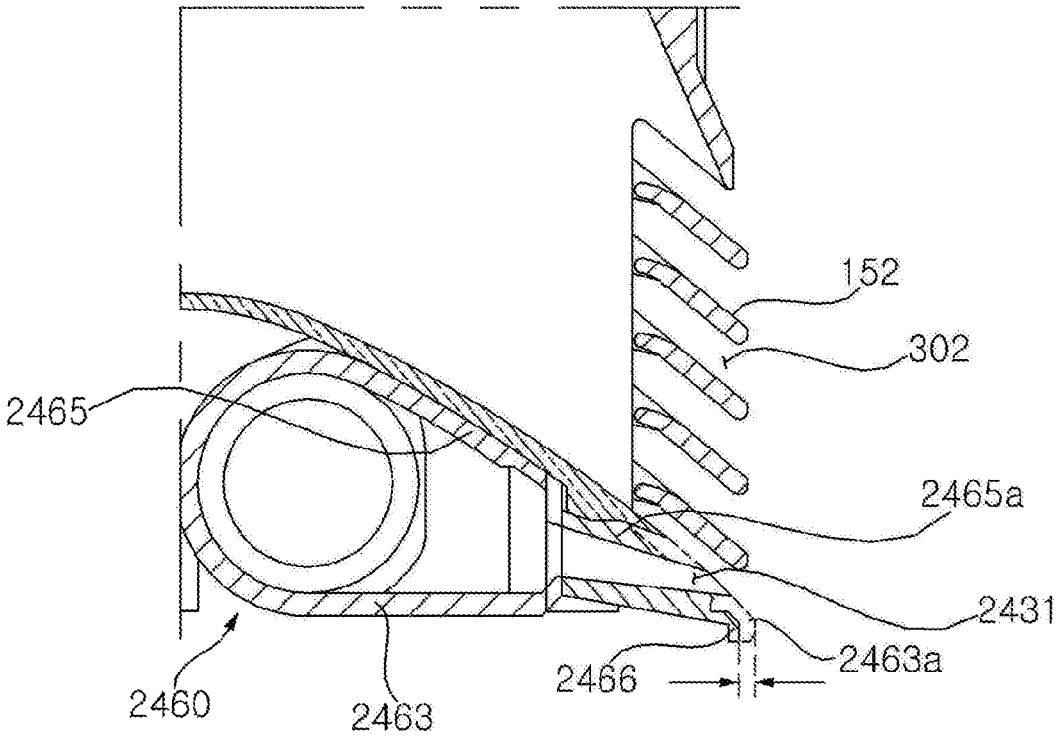
FIG. 21 is a cross-sectional view illustrating a fourth exemplary diffuser.

FIG. 21 is a cross-sectional view illustrating a fourth exemplary diffuser.

In the fourth exemplary diffuser, the left-right length of the protrusion 2466 may be reduced by a predetermined length (in this embodiment, 2 mm) to minimize formation of droplets at the front panel side.

The rest of the configurations of the fourth exemplary diffuser are the same as the configurations of the first exemplary diffuser. Therefore, detailed description in relation to the rest of the configurations is omitted.

Figure 22:
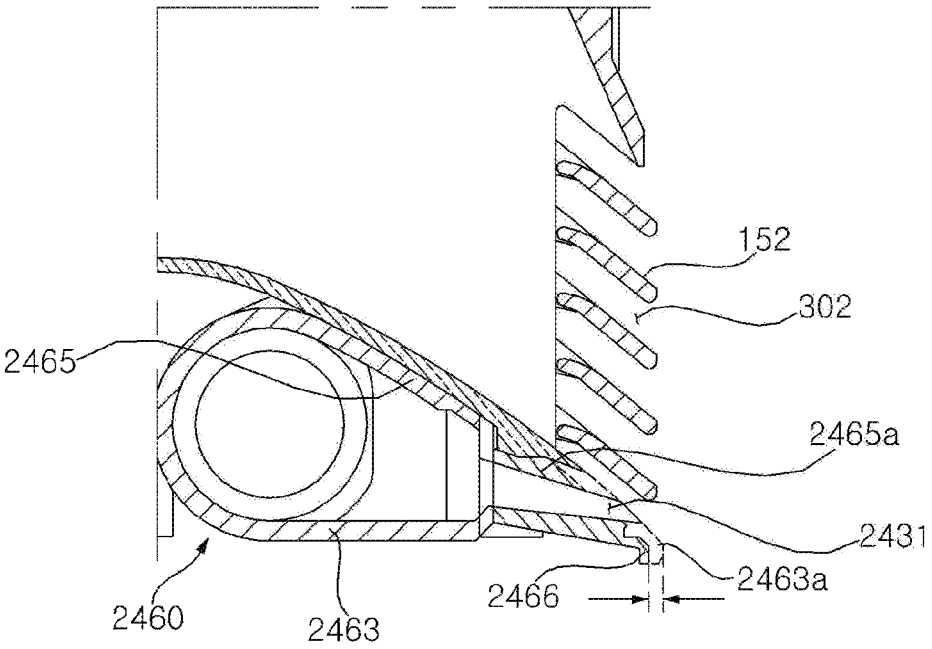
FIG. 22 is a cross-sectional view illustrating a fifth exemplary diffuser.

FIG. 22 is a cross-sectional view illustrating a fifth exemplary diffuser.

Unlike the first exemplary diffuser, the fifth exemplary diffuser includes a step 2467, which may be concavely formed inwards, at the outer end 2463*a* of the front diffuser hosing 2463, and includes a step 2468, which may be concavely formed inwards, at the outer end 2465*a* of the rear diffuser housing 2465, to minimize formation of droplets at the front panel side.

Through the step 2467, a length of the outer end 2463*a* of the front diffuser hosing 2463 is reduced. At least part of the protrusion 2466 may be removed by the step 2467. The protrusion 2466 may be formed to extend in the up-down direction, and a part of the entire length of the step 2467 may only be removed.

Through the step 2468, a length of the outer end 2465*a* of the rear diffuser housing 2465 may also be reduced.

Through the step 2467, 2468, formation of droplets may be suppressed.

The rest of the configurations of the fifth exemplary diffuser are the same as the configurations of the first exemplary diffuser. Therefore, detailed description in relation to the rest of the configurations is omitted.

The present disclosure has been described with reference to the embodiments illustrated in the drawings. However, the disclosure should not be construed as being limited to the embodiments set forth herein and may be manufactured in various different forms. Additionally, one having ordinary skill in the art to which the disclosure pertains may understand that the present disclosure may be embodied in various specific forms without departing from the technical spirit or the essential features of the disclosure. Therefore, it should be understood that the above-described embodiments are provided only as examples and are not limited in all aspects.

What is claimed is:

1. An indoor unit for an air conditioner comprising:

a cabinet forming an internal space, wherein the cabinet includes an inlet through which indoor air is introduced into the internal space and an outlet through which air in the internal space is discharged to an indoor space;

a fan assembly disposed in the internal space and discharging air, suctioned through the inlet, to the outlet;

a grill disposed at the outlet to guide discharged air discharged by the fan assembly;

a front panel disposed at a front of the cabinet assembly;

a humidified air generator disposed in the cabinet to evaporate water stored therein and generate humidified air; and a diffuser coupled to the humidified air generator, to receive the humidified air and discharge the humidified air to the indoor space, wherein the diffuser includes a diffuser outlet through which the humidified air is discharged, wherein the diffuser outlet is placed between the front panel and the grill with respect to a front-rear direction, and wherein a first distance is formed between an outer end of the diffuser, where the humidified air is discharged to the indoor space, and an outer surface of the front panel located along the outer end of the diffuser in a direction from the outer surface of the front panel to a center of the panel.

2. The indoor unit of claim 1, wherein the front panel and the diffuser outlet are spaced apart in the front-rear direction.

3. The indoor unit of claim 1, wherein the front panel is made of a metallic material, and wherein the diffuser outlet is disposed behind a rear end of a left surface of the front panel and a rear end of a right surface of the front panel.

4. The indoor unit of claim 1, wherein the grill includes a vane that guides a discharge direction of air, and wherein the diffuser and the vane are placed such that a discharge direction of the humidified air discharged from the diffuser outlet and an inclination direction of the vane cross.

5. The indoor unit of claim 4, wherein the diffuser further comprises:

a front diffuser housing plate that forms a front surface of the diffuser; and a rear diffuser housing plate that forms a rear surface of the diffuser, wherein the diffuser outlet is formed between an outer end of the front diffuser housing plate and an outer end of the rear diffuser housing plate.

6. The indoor unit of claim 4, wherein a plurality of vanes are placed in the front-rear direction, wherein a front surface of the front panel and an inclination direction of the plurality of vanes form a first contained angle, the front diffuser housing plate and the front surface of the front panel form a second contained angle, the rear diffuser housing plate and the front surface of the front panel form a third contained angle, and wherein the third contained angle is greater than the second contained angle and is smaller than the first contained angle.

7. The indoor unit of claim 6, wherein the fan assembly further comprises:

a hub;

a rotating shaft coupled at a center of the hub;

a shroud spaced apart from a rear of the hub and including an inlet into which air is suctioned at a central portion thereof; and a fan comprising a plurality of blades placed between the hub and the shroud, wherein a direction faced by an outer circumferential end of the shroud and a front surface of the front panel form a fourth contained angle smaller than the first contained angle.

8. The indoor unit of claim 7, wherein the diffuser outlet and the plurality of vanes are placed within a space between a first virtual line extended in a direction faced by an outer circumferential end of the hub and a second virtual line extended in a direction faced by the outer circumferential end of the shroud.

9. The indoor unit of claim 4, wherein an outer end of a frontmost vane among the plurality of vanes is placed between an outer end of the front diffuser housing plate and an outer end of the rear diffuser housing plate with respect to a left-right direction that is a widthwise direction of the front panel.

10. The indoor unit of claim 8, wherein the front panel further comprises:

a front panel body forming a front surface of the front panel; and a front panel side that extends rearwards from an edge of the front panel body in a lateral direction of the front panel body forming a lateral surface of the front panel, wherein the diffuser further includes a protrusion that protrudes forwards from the outer end of the front diffuser housing plate.

11. The indoor unit of claim 10, wherein a front-rear distance between an end at a front of the protrusion and a rear end of the front panel side is at least 2 mm.

12. The indoor unit of claim 10, wherein a total of the front-rear distance between the end at the front of the protrusion and the rear end of the front panel side, and the front-rear length of the protrusion is between 5 and 10 mm, inclusive.

13. The indoor unit of claim 10, wherein the protrusion of the diffuser outlet is placed further inwards than an outer surface of the front panel side.

14. The indoor unit of claim 1, wherein the front panel further comprises:

a front panel body forming a front surface of the front panel; and a front panel side that extends rearwards from an edge of the front panel body in a lateral direction of the front panel body forming a lateral surface of the front panel body, wherein an outer end of the diffuser outlet is placed further rearwards than a rear end of the front panel side, and the outer end of the diffuser outlet is placed further inwards than the outer surface of the front panel side.

15. The indoor unit of claim 1, wherein the first distance is 1 mm or more.

* * * * *